US009075336B2

(12) United States Patent
Momomura et al.

(10) Patent No.: US 9,075,336 B2
(45) Date of Patent: Jul. 7, 2015

(54) BLOWER PIPE, BLOWING DEVICE, AND IMAGE FORMING APPARATUS

(71) Applicant: FUJI XEROX CO., LTD., Tokyo (JP)

(72) Inventors: Yasunori Momomura, Kanagawa (JP); Yuki Nagamori, Kanagawa (JP); Koji Otsuka, Kanagawa (JP); Kazuki Inami, Kanagawa (JP); Masafumi Kudo, Kanagawa (JP); Hideki Okamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 52 days.

(21) Appl. No.: 13/909,543

(22) Filed: Jun. 4, 2013

(65) Prior Publication Data

US 2014/0169825 A1 Jun. 19, 2014

(30) Foreign Application Priority Data

Dec. 13, 2012 (JP) ..... 2012-272359

(51) Int. Cl.
*G03G 21/20* (2006.01)
*G03G 15/02* (2006.01)
*F24F 13/02* (2006.01)

(52) U.S. Cl.
CPC ..... *G03G 15/0291* (2013.01); *G03G 21/206* (2013.01); *F24F 13/0245* (2013.01)

(58) Field of Classification Search
CPC ..... G03G 15/0865; G03G 15/0233; G03G 15/0812; G03G 15/0815; G03G 15/10; G03G 15/11; G03G 15/1685; G03G 15/23; G03G 15/235; G03G 15/6529
See application file for complete search history.

(56) References Cited

U.S. PATENT DOCUMENTS

2005/0053396 A1* 3/2005 Kubo et al. ..... 399/170
2006/0045558 A1* 3/2006 Nishida et al. ..... 399/93
2007/0098445 A1* 5/2007 Takiguchi et al. ..... 399/171

FOREIGN PATENT DOCUMENTS

JP A-10-198128 7/1998

* cited by examiner

*Primary Examiner* — Roy Y Yi
(74) *Attorney, Agent, or Firm* — Oliff PLC

(57) ABSTRACT

A blower pipe includes an inlet port, an outlet port, a flow path that connects the inlet port and the outlet port to cause air to flow therethrough and that are divided by a partition wall, and plural flow control members that are respectively provided in different parts in an air flow direction in each of divided passage spaces that are divided by the partition wall and that control the flow of the air, wherein the inlet port and the outlet port are constituted by plural opening portions, respectively, the plural opening portions that constitute the outlet port have elongated opening shapes divided by the partition wall, and a flow control member of the plural flow control members closest to the inlet port is provided in the vicinity of the bent portion.

12 Claims, 21 Drawing Sheets

BLOWER PIPE, BLOWING DEVICE, AND IMAGE FORMING APPARATUS

CROSS-REFERENCE TO RELATED APPLICATIONS

This application is based on and claims priority under 35 USC 119 from Japanese Patent Application No. 2012-272359 filed Dec. 13, 2012.

BACKGROUND (i) Technical Field

The present invention relates to a blower pipe, a blowing device, and an image forming apparatus.

(ii) Related Art

In image forming apparatuses that form an image constituted with a developer on a recording sheet, for example, there is an image forming apparatus using a corona discharger that performs corona discharge in the process of charging a latent image holding member, such as a photoconductor or the process of neutralization, the process of transferring an unfixed image to the recording sheet, or the like.

Additionally, in the corona discharger, in order to prevent unnecessary substances, such as paper debris or a discharge product, from adhering to component parts, such as a discharge wire or a grid electrode, a blowing device that blows air against component parts may be provided. The blowing device in this case is generally constituted by a blower that sends air, and a duct (blower pipe) that guides and sends out the air sent from the blower to a target structure, such as a corona discharger.

In the related art, improvements for enabling air to be uniformly blown in the longitudinal direction of the component parts, such as a discharge wire, are variously performed on the blowing device or the like. Particularly, for a blowing device or the like, there is proposed a blowing device that does not adopt a configuration, in which the shape of a passage space of a duct through which air is caused to flow is formed in a special shape, or a configuration, in which a straightening vane or the like that adjusts a direction in which air flows is installed in the passage space of the duct, or the like, but the blowing device adopts separate configurations as illustrated below.

SUMMARY

According to an aspect of the invention, there is provided a blower pipe including: an inlet port that takes in air; an outlet port that has an elongated opening shape that is parallel to a portion of a elongated target structure in a longitudinal direction and that is arranged so as to face the portion of the elongated target structure in the longitudinal direction against which the air taken in from the inlet port is to be blown and is different from the opening shape of the inlet port; a flow path that connects the inlet port and the outlet port to cause air to flow therethrough and that are divided by a partition wall that is continuously provided from the inlet port to the outlet port and that has a bent portion which bends flow direction substantially at a right angle; and plural flow control members that are respectively provided in different parts in an air flow direction in each of divided passage spaces that are divided by the partition wall and that control the flow of the air, wherein the inlet port and the outlet port are constituted by plural opening portions that are divided by the partition wall, respectively, wherein the plural opening portions that constitute the outlet port have elongated opening shapes that are divided by the partition wall in a state where the elongated opening shape of the outlet port is parallel to the longitudinal direction of the target structure, and wherein a flow control member of the plural flow control members closest to the inlet port is provided in the vicinity of the bent portion, which makes a portion of each of the flow path narrower than other portion of each of the flow path and makes an elongated gap extending in the longitudinal direction to pass air.

BRIEF DESCRIPTION OF THE DRAWINGS

Exemplary embodiments of the present invention will be described in detail based on the following figures, wherein:

FIG. 1 is an explanatory view showing the outline of a blower pipe and a blowing device and an image forming apparatus using the same related to Exemplary Embodiment 1 or the like;

FIG. 4 is a perspective view showing the blower duct of FIG. 3 that is partially seen through;

FIG. 14A is a streamline view showing the results when the blower duct of the configuration example shown in FIG. 12 is applied, and FIG. 14B is a streamline view showing the results when the blower duct of the configuration example shown in FIG. 13 is applied;

FIG. 21A is a graph chart showing the results of the evaluation test regarding the performance characteristics when a certain air volume of air is taken into the blower duct, and FIG. 21B is a graph chart showing the results of the evaluation test when a larger air volume air than that of the case of FIG. 21A is taken in.

DETAILED DESCRIPTION

Hereinafter, the modes (simply referred to as "exemplary embodiments") for carrying out the invention will be described with reference to the accompanying drawings.

Exemplary Embodiment 1

Figure 1:
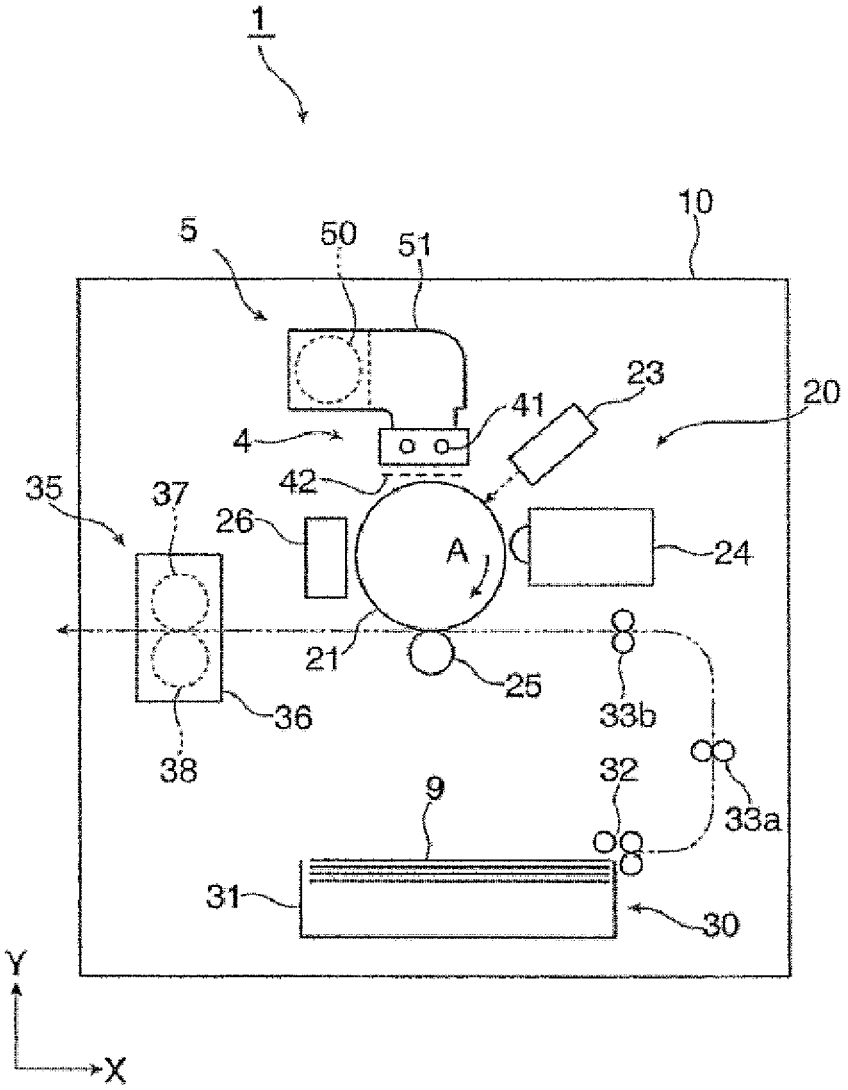
Figure 2:
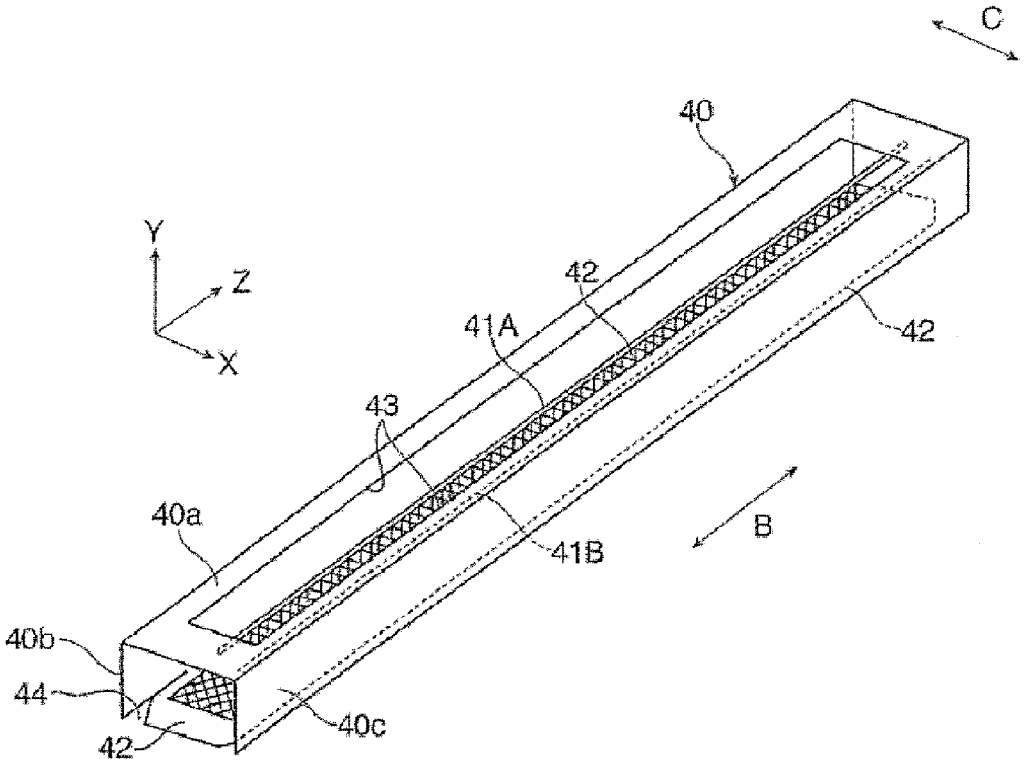
FIG. 2 is a schematic perspective view showing a charging device including a corona discharger provided in the image forming apparatus of FIG. 1.
Figure 3:
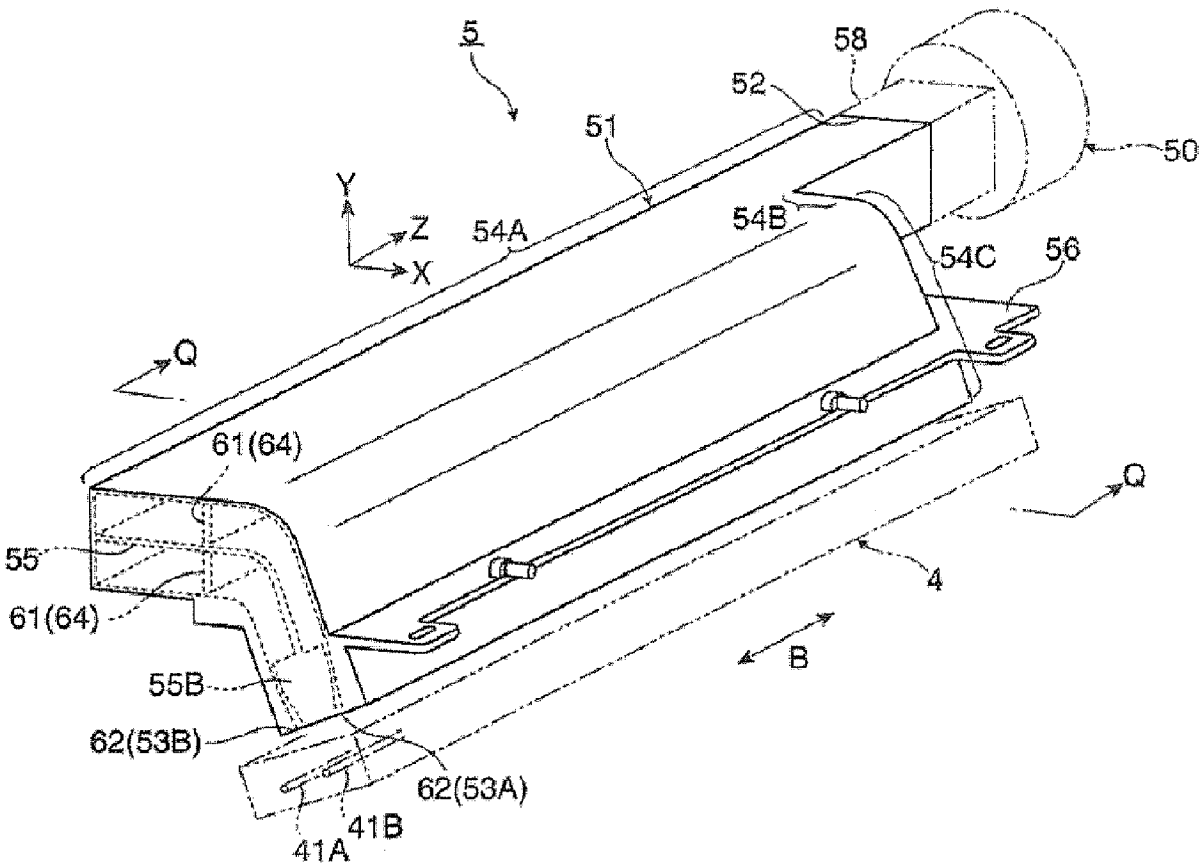
FIG. 3 is a schematic perspective view showing the outline of a blower pipe and a blowing device to be applied to the charging device of FIG. 2.

FIGS. 1 to 3 show a blower pipe related to Exemplary Embodiment 1 and a blowing device and an image forming apparatus using the same. FIG. 1 shows the outline of the image forming apparatus, FIG. 2 shows a charging device as an example of an elongated target structure on which air is to be blasted by the blower pipe or the blowing device, in the image forming apparatus, and FIG. 3 shows the outline of the blower duct or the blowing device.

In the image forming apparatus 1, as shown in FIG. 1, an image forming unit 20 that forms a toner image constituted by a toner as a developer to transfer the toner to a sheet 9 as an example of a recording material, a sheet feeder 30 that accommodates and transports sheets 9 to be supplied to the image forming unit 20, and a fixing device 35 that fixes the toner image formed by the image forming unit 20 on a sheet 9 are installed in an internal space of a housing 10 constituted by a support frame, an outer cover, or the like. Although only one image forming unit 20 is illustrated in Exemplary Embodiment 1, a configuration in which the image forming unit is constituted by plural image forming units may be adopted.

The above image forming unit 20 is configured, for example utilizing a well-known electrophotographic system, and is mainly constituted by a photoconductor drum 21 that is rotationally driven in the direction (the clockwise direction in FIG. 1) indicated by an arrow A, a charging device 4 that charges a peripheral surface that is an image forming region of the photoconductor drum 21 with a required potential, an exposure device 23 that irradiates the surface of the photoconductor drum 21 after charging with light (dotted line with an arrow) based on image information (signal) input from the outside to thereby form an electrostatic latent image with a potential difference, a developing device 24 that develops the electrostatic latent image as a toner image with a toner, a transfer device 25 that transfers the toner image to a sheet 9, and a cleaning device 26 that removes the toner or the like that remains on the surface of the photoconductor drum 21 after transfer.

Among these, a corona discharger is used as the charging device 4. The charging device 4 including this corona discharger is constituted by a so-called scorotron type corona discharger, as shown in FIG. 2 or the like.

Figure 4:
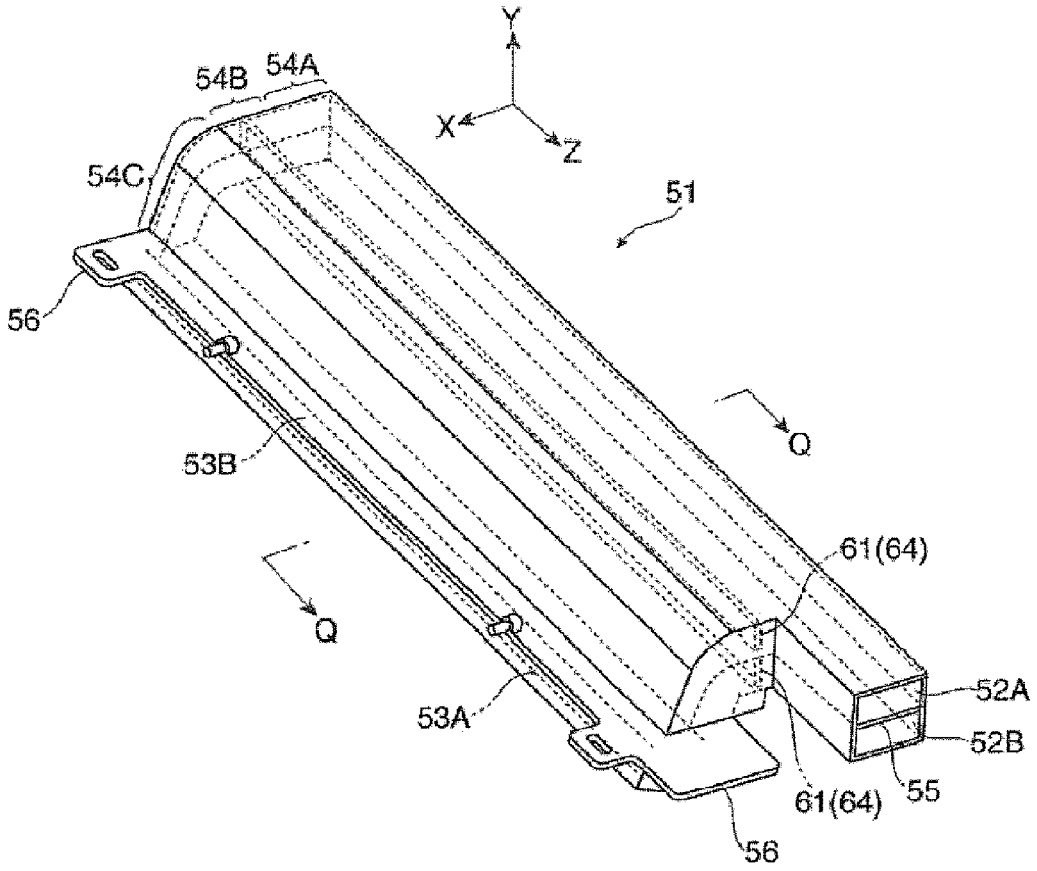

That is, the charging device 4 includes a shielding case 40 as an example of a surrounding member with an external shape having an oblong top plate 40*a*, and lateral portions 40*b* and 40*c* that hang downward from long side portions extending along the longitudinal direction B of the top plate 40*a*, two end supports (not shown) that are respectively attached to both ends (short side portions) of the shielding case 40 in the longitudinal direction B, two corona discharge wires 41A and 41B that are attached so as to be stretched in a state where the wires are present within an elongated internal space extending along the longitudinal direction B of the shielding case 40 and are substantially parallel to each other, between these two end supports, and a perforated grid electrode (electric field adjustment plate) 42 that is attached to a lower opening portion 44 for discharge of the shielding case 40 in a state where the plate substantially covers the lower opening portion 44 and is present between the corona discharge wires 41 and the peripheral surface of the photoconductor drum 21. Reference numeral 40*d* shown in FIG. 4 or the like represents a boundary plate that partitions the space where the two corona discharge wires 41A and 41B are arranged, along the longitudinal direction B of the shielding case 40. The opening shape of the lower opening portion 44 becomes oblong.

Additionally, the charging device 4 is arranged such that the two corona discharge wires 41A and 41B are present at least so as to face an image forming target region along the direction of a rotational axis of the photoconductor drum 21 in a state where the wires face each other at a predetermined interval (for example, discharge gap) from the peripheral surface of the photoconductor drum 21. Additionally, the charging device 4 is adapted such that charging voltages are respectively applied to the discharge wires 41A and 41B (between the wires and the photoconductor drum 21) from a power unit (not shown) when an image is formed.

Moreover, with the use of the charging device 4, substances (unnecessary substances), such as paper debris of a sheet 9, a discharge product generated by corona discharge, and external additives of toner, adhere to the corona discharge wires 41 or the grid electrode 42, and are contaminated, and the corona discharge is no longer sufficiently or uniformly performed. As a result, charging defects, such as uneven charging, may occur. For this reason, in order to prevent or keep unnecessary substances from adhering to the discharge wires 41 and the grid electrode 42, a blowing device 5 for blasting air against two internal spaces S1 and S2 (spaces where the discharge wires 41A and 41B are present, respectively) partitioned by the boundary plate 40*d* of the shielding case 40 is provided together at the charging device 4. Additionally, the top plate 40*a* of the shielding case 40 of the charging device 4 is formed with an opening 43 for taking in the air from the blowing device 5. The opening 43 is formed so that the opening shape thereof is an elongated oblong shape. The blowing device 5 will be described below in detail.

The sheet feeder 30 includes a sheet accommodation member 31 of a tray type, a cassette type, or the like that accommodates plural sheets 9 including a required size, required kind, or the like to be used for formation of an image, in a stacked state, and a delivery device 32 that delivers the sheets 9 accommodated in the sheet accommodation member 31 one by one toward a transporting path. If the timing for sheet feeding comes, the sheets 9 are delivered one by one. Plural sheet accommodation members 31 are provided according to utilization modes. A one-dot chain line with an arrow in FIG. 1 shows a transporting path which a sheet 9 is mainly transported along and passes through. This transporting path for sheets is constituted by plural sheet transporting roll pairs 33*a* and 33*b*, transporting guide members (not shown), or the like.

The fixing device 35 includes, inside a housing 36 formed with an introduction port and an ejection port through which a sheet 9 passes, a roll-shaped or belt-shaped heating rotary member 37 of which the surface temperature is heated to and maintained at a required temperature by a heating unit, and a roll-shaped or belt-shaped pressurizing rotary member 38 that is rotationally driven in contact with the heating rotary member 37 at a required pressure so as to extend substantially along the direction of the rotational axis of the heating rotary member. The fixing device 35 performs fixing by allowing a sheet 9 after a toner image is transferred to be introduced into and pass through a contact portion (fixing processing section) that is formed as the heating rotary member 37 and the pressurizing rotary member 38 come into contact with each other.

Image formation by the image forming apparatus 1 is performed as follows. Here, a basic image forming operation when an image is formed on one surface of a sheet 9 will be described as a representative example.

In the image forming apparatus 1, if the control device or the like receives a start command for an image forming operation, in the image forming unit 20, the peripheral surface of the photoconductor drum 21 that starts to rotate is charged with predetermined polarity and potential by the charging device 4. At this time, in the charging device 4, corona discharge is generated in a state where charging voltages are applied to the two corona discharge wires 41A and 41B, respectively, and an electric field is formed between each of the discharge wires 41A and 41B and the peripheral surface of the photoconductor drum 21, and thereby, the peripheral surface of the photoconductor drum 21 is charged with a required potential. In this case, the charging potential of the photoconductor drum 21 is adjusted by the grid electrode 42.

Subsequently, an electrostatic latent image, which is configured with a required potential difference as exposure is performed on the basis of image information from the exposure device 23, is formed on the peripheral surface of the charged photoconductor drum 21. Thereafter, when the electrostatic latent image formed on the photoconductor drum 21 passes through the developing device 24, the electrostatic latent image is developed with a toner that is supplied from the developing roll 24*a* and charged with a required polarity, and is visualized as a toner image.

Next, if the toner image formed on the photoconductor drum 21 is transported to a transfer position that faces the transfer device 25 by the rotation of the photoconductor drum 21, the toner image is transferred by the transfer device 25 to a sheet 9 to be supplied through the transporting path from the sheet feeder 30 according to this timing. The peripheral surface of each photoconductor drum 21 after this transfer is cleaned by the cleaning device 26.

Subsequently, the sheet 9 to which the toner image is transferred in the image forming unit 2 is transported so as to be introduced into the fixing device 35 after being peeled off from the photoreceptor drum 21, is heated under pressurization when passing through the contact portion between the heating rotary member 37 and the pressurizing rotary member 38 in the fixing device 35, and is fixed on the sheet 9. The sheet 9 after this fixing is completed is ejected from the fixing device 35, and is transported and accommodated in an ejected sheet accommodation section (not shown) or the like that is formed, for example, outside the housing 10.

From the above, a monochrome image constituted by a single-color toner is formed on one surface of one sheet 9, and the basic image forming operation is completed. When there is an instruction for the image forming operation for plural sheets, a series of operations as described above are similarly repeated by the number of sheets.

Next, the blowing device 5 will be described.

As shown in FIG. 1, 3, or the like, the blowing device 5 includes a blower 50 that has a rotary fan that sends air, and a blower duct 51 that takes in the air sent from the blower 50 and guides and blows out the air to the charging device 4 that is an object to be blown.

As the blower 50, for example, an axial flow type blower fan is used and the driving thereof is controlled so as to send a required volume of air. Additionally, the blower duct 51, as shown in FIGS. 3 to 6, is formed in a shape having an inlet port 52 that takes in the air sent from the blower 50, an outlet port 53 that is arranged in a state where the outlet port faces the portion (the top plate 40*a* of the shielding case 40), in the longitudinal direction B, of the elongated charging device 4 against which the air taken in from the inlet port 52 is to be blown, and emits the air so as to flow along a direction orthogonal to the longitudinal direction B, and a flow path (body portion) 54 formed with a passage space TS for connecting the inlet port 52 and the outlet port 53 to cause air to flow therethrough.

The flow path 54 of the blower duct 51 is constituted by an introduction flow path 54A, a first bent flow path 54B, and a second bent flow path 54C as will be described below in detail. The introduction flow path 54A has one end portion provided with the inlet port 52 opened and has the other end portion closed, and the overall flow path is constituted by an angular-tube-shaped flow path formed so as to extend along the longitudinal direction B of the charging device 4. The first bent flow path 54B is an angular-tube-shaped bent flow path formed so as to extend after being bent substantially at a right angle to a substantially horizontal direction (direction substantially parallel to the coordinate axis X) in a state where the width of the passage space is increased from a part near the other end portion of the introduction flow path 54A. The second bent flow path 54C is a second bent flow path formed so as to extend after being finally bent in a downwardly perpendicular direction (direction substantially parallel to the coordinate axis Y) so as to move close to the charging device 4 in a state where the width of the passage space remains equal from one end portion of the first bent flow path 54B. Among these, the widths (dimensions along the longitudinal direction B) of both the passage spaces TS of the first bent flow path 54B and the second bent flow path 54C are set to almost the same dimension.

The overall opening shape (the shape of the inlet port before a passage space is divided by a partition wall 55 to be described below) of the inlet port 52 of the blower duct 51 is formed so as to become, for example, a substantially square shape. A connection duct 58 for connecting between the blower duct 52 and the blower 50 to send the air generated by the blower 50 to the inlet port 52 of the blower duct 51 is attached between both the blower duct and the blower (FIG. 3).

Additionally, the outlet port 53 of the blower duct 51 is formed so that the opening shape (the shape of the outlet port before a passage space is divided by the partition wall 55 to be described below) thereof is an elongated shape (for example, oblong shape) parallel to the portion of the charging device 4 in the longitudinal direction B. The outlet port 53 is actually formed at a termination end of the second bent flow path 54C of the blower duct 51. For this reason, the blower duct 51 has the relationship where the inlet port 52 and the outlet port 53 are formed in different opening shapes. In addition, even in a case where the inlet port 52 and the outlet port 53 have the same type of shape, a case where the inlet port and the outlet port are formed so as to have different opening areas (when the inlet port and outlet port have a similar shape) is included in the relationship where the inlet port and the outlet port are formed in different opening shapes.

Here, in the blower duct 51 in which the inlet port 52 and the outlet port 53 are formed in different opening shapes in this way, the portion in which the cross-sectional shape of the passage space TS is changed midway is present in the flow path 54 that connects between the inlet port 52 and the outlet port 53. Incidentally, in the blower duct 51, the cross-sectional shape of the passage space TS having a substantially square shape, of the introduction flow path 54A is changed to the cross-sectional shape of the passage space TS including an oblong shape that widens only in the horizontal direction (no change in height) in the first bent flow path 54B. In other words, the cross-sectional shape of the passage space TS of the introduction flow path 54A is the cross-sectional shape of the passage space TS that abruptly becomes wide in the first bent flow path 54B.

Additionally, in the case of the blower duct 51 in which such a portion in which the cross-sectional shape of the passage space TS changes is present, disturbance, such as flaking or vortex, occurs in the flow of air in the portion in which the cross-sectional shape of the blower duct changes. For this reason, even if air with a uniform wind speed is taken from the inlet port 52, the wind speed of the air that comes out from the outlet port 53 tends to become non-uniform. In addition, the tendency that the wind speed of the air that comes out from the outlet port becomes non-uniform in this way occurs almost similarly even in a case where the direction in which the air in the blower duct 51 is caused to flow (proceed) changes irrespective of the presence of a change in the cross-sectional shape of the passage space TS.

Figure 19A:
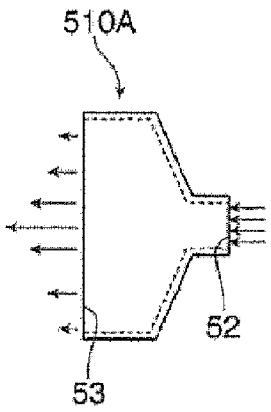
FIGS. 19A to 19D are top explanatory views showing various form examples of the blower duct.
Figure 19B:
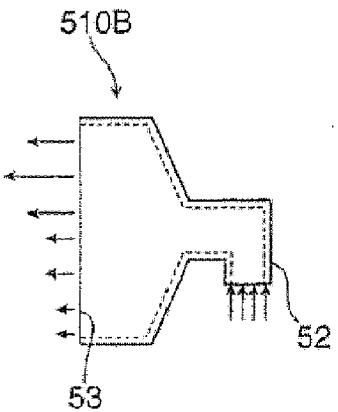
Figure 19C:
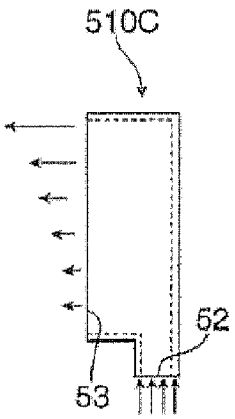
Figure 19D:
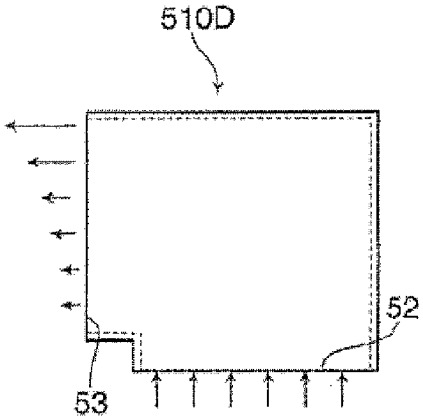

FIGS. 19A to 19C show representative examples 510A to 510C of the blower duct in which the inlet port 52 and the outlet port 53 are formed in different opening shapes. In the drawings, respective states of the wind speed of air taken into the inlet port 52 and the wind speed of air that comes out from the outlet port 53 in the respective ducts 510 are shown by the lengths of arrows, respectively. FIGS. 19A to 19D show the respective blower ducts 510 seen from the top face thereof. Additionally, in the drawings, cases where the lengths of the arrows are the same show that the wind speeds are the same, and cases where the lengths of the arrows are different show that the wind speeds are different. Moreover, dotted lines in the drawings show (side wall portions that form) the passage spaces of the respective ducts. Incidentally, the blower ducts 510B and 510D are also configuration examples in which the direction in which air is caused to flow is changed midway, and at least one of the cross-sectional shape and cross-sectional area of the passage spaces is changed. In addition, the blower duct 510D shown in FIG. 19D is a configuration example in which the inlet port 52 and the outlet port 53 are formed in the same opening shape (and the same opening area), and is a duct in which only the direction in which air is caused to flow is changed midway.

Thus, in the blower duct 51 of the blowing device 5, as shown in FIGS. 3 to 8 or the like, the flow path 54 is constituted as the flow path 54 that has two passage spaces TS1 and TS2 divided so as to have almost the same space shape by a plate-shaped partition wall 55 provided in a state where the passage space TS is continuous from the inlet port 52 to the outlet port 53, and, two flow control members 61 and 62 that suppress the flow of air are provided in different parts in the direction in which the air of each of the divided passage spaces TS1 and TS2 of the flow path 64 is caused to flow.

One flow control member 61 is an upstream flow control member provided in a midway part in the air flow direction, of each passage space TS1 or TS2 of the flow path 54. Additionally, the other flow control member 62 is a most downstream flow control member provided on the outlet port 53 side of each passage space TS1 or TS2 of the flow path 54. Reference numeral 56 in FIG. 3 or the like represents an attachment auxiliary portion formed in a desired shape for fixing the blower duct 51 to its attachment place.

In the blower duct 51, the inlet port 52 and the outlet port 53 are divided by the partition wall 55 of the flow path 54, respectively, and are constituted by two opening portions, respectively. That is, the inlet port 52 is constituted by two opening portions 52A and 52B, and the outlet port 53 is constituted by two opening portions 53A and 53B.

The opening portions 52A and 52B that constitute the inlet port 52 in Exemplary Embodiment 1 are provided so that an opening portion having an original square shape, of the inlet port 52 is substantially equally divided into two that are parted in the vertical direction by the partition wall 55, and both the opening shapes thereof are formed in a short oblong shape. Additionally, the opening portion 52A and the opening portion 52B that constitute the outlet port 53 are substantially equally divided into two by the partition wall 55 so that an original elongated oblong opening portion of the outlet port 53 is parallel along the longitudinal direction B of the charging device 4, and both the opening shapes thereof are formed in a subdivided elongated oblong shape. Even in this case, since the opening shape of the opening portions 52A and 52B that constitute the inlet port 52 and the opening shape of the two opening portions 53A and 53B that constitute the outlet port 53 are a short oblong shape and an elongated oblong shape, respectively, as described above, these opening portions remain in the relationship of different opening shapes.

Additionally, the upstream flow control member 61 is provided at a substantially intermediate position in the direction in which air is caused to flow in each passage space TS1 or TS2 of the first bent flow path 54B. The upstream flow control member 61 is configured so as to cut off a portion of each passage space TS1 or TS2 in such a manner to cross each passage space TS1 or TS2 of the first bent flow path 54B along the direction parallel to the longitudinal direction (the same direction as the longitudinal direction B of the charging device 4) of the opening shape of each opening portion 53A or 53B of the outlet port 53, and so as to have a gap 63 in an elongated shape that extends in the crossing direction.

The upstream flow control member 61 in Exemplary Embodiment 1 is configured by causing a plate-shaped partition member 64 to be present within each passage space TS1 or TS2 of the bent flow path 54B without changing the external shape of the first bent flow path 54B. That is, the upstream flow control member 61 is arranged so that the partition member 64 closes an upper space portion in each passage space TS1 or TS2 of the first bent flow path 54B, and a lower end 64*a* of the partition member has a required interval H with respect to the bottom (inner wall) of the passage space TS. This forms a structure where the gap 63 is present in a lower portion of each passage space TS1 or TS2. The partition member 64 is formed by being molded integrally with the duct 51 from the same material as the duct or is formed from a material separate from the duct 51.

The height H, path length M, and width (length along the longitudinal direction B) W of the gap 63 are selected and set from the viewpoint of making the wind speed of air that has flowed into the first bent flow path 54B from the introduction flow path 54A as uniform as possible, and are set in consideration of the dimensions (capacity) of the duct 51, and the flow rate per unit time of air caused to flow to the duct 51, the charging device 4, or the like. For example, the height H of the gap 63 may be set to the dimension uniformly or partially changed from the above viewpoint or the like without being limited to a case where the dimension is set to the same dimension in the width direction. In Exemplary Embodiment 1, as for the height H of the gap 63, a configuration in which a height H1 in an end portion near the inlet port 52 and a height H2 in an end portion apart from the inlet port 52 are set to almost the same value (that is, a case where the heights are set to the same dimension in the width direction of the gap 63) is shown.

Figure 5:
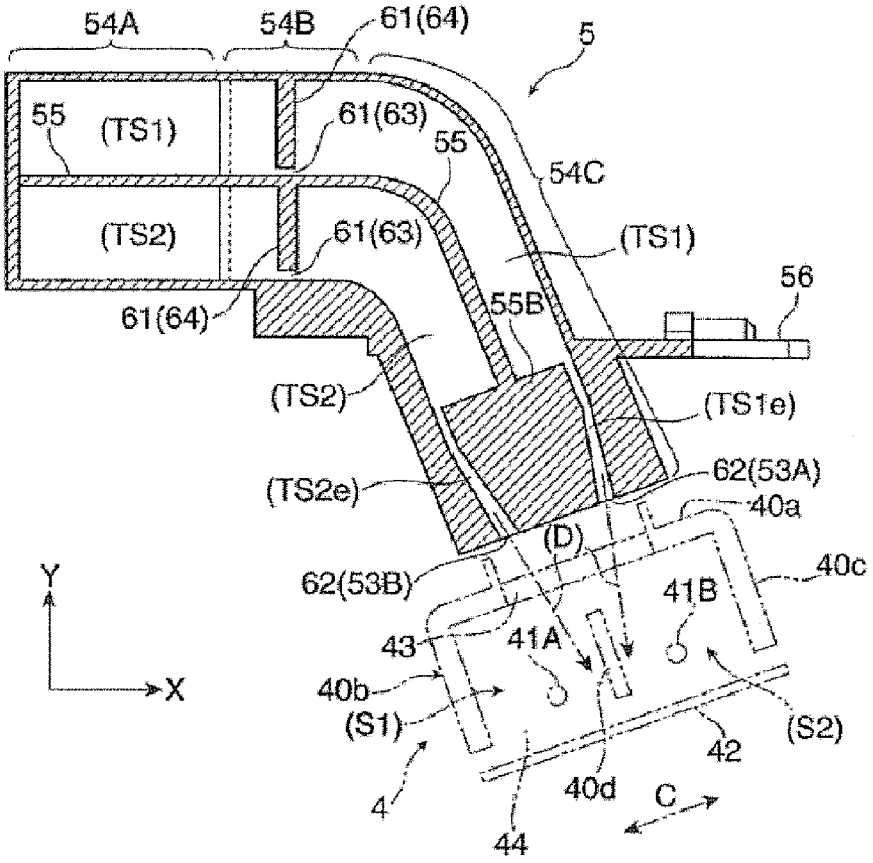
FIG. 5 is a cross-sectional view along line Q-Q of the blowing device (blower duct) of FIG. 3.

On the other hand, in the most downstream flow control member 62, the opening portion 53A or 53B of the outlet port 53 of each passage space TS1 or TS2 is formed in a shape having a smaller cross-sectional area than the cross-sectional area of each passage space TS1 or TS2. The opening shape of the opening portion 53A or 53B in Exemplary Embodiment 1 is formed in an elongated oblong shape in which only the length (sides that are present at both ends in the longitudinal direction) of the short sides of the elongated oblong shape are made shorter than the short sides of the oblong cross-sectional shape of each passage space TS1 or TS2, and the length of the long sides thereof is the same as the long sides of the oblong cross-sectional shape of each passage space TS1 or TS2. The opening portions 53A and 53B at this time face the internal spaces S1 and S2, respectively, which are divided into two by the boundary plate 40*d*, in a corresponding manner through the top opening portion 32 of the shielding case 40 of the charging device 4 (FIG. 5).

Additionally, in the most downstream flow control member 62, the opening portion 53A or 53B of the outlet port 53 of each passage space TS1 or TS2 is also configured as the shape of a terminal portion of a passage space TS1*e* or TS2*e* that guides air so as to be emitted in a required direction and determines the emission direction of air.

Figure 8:
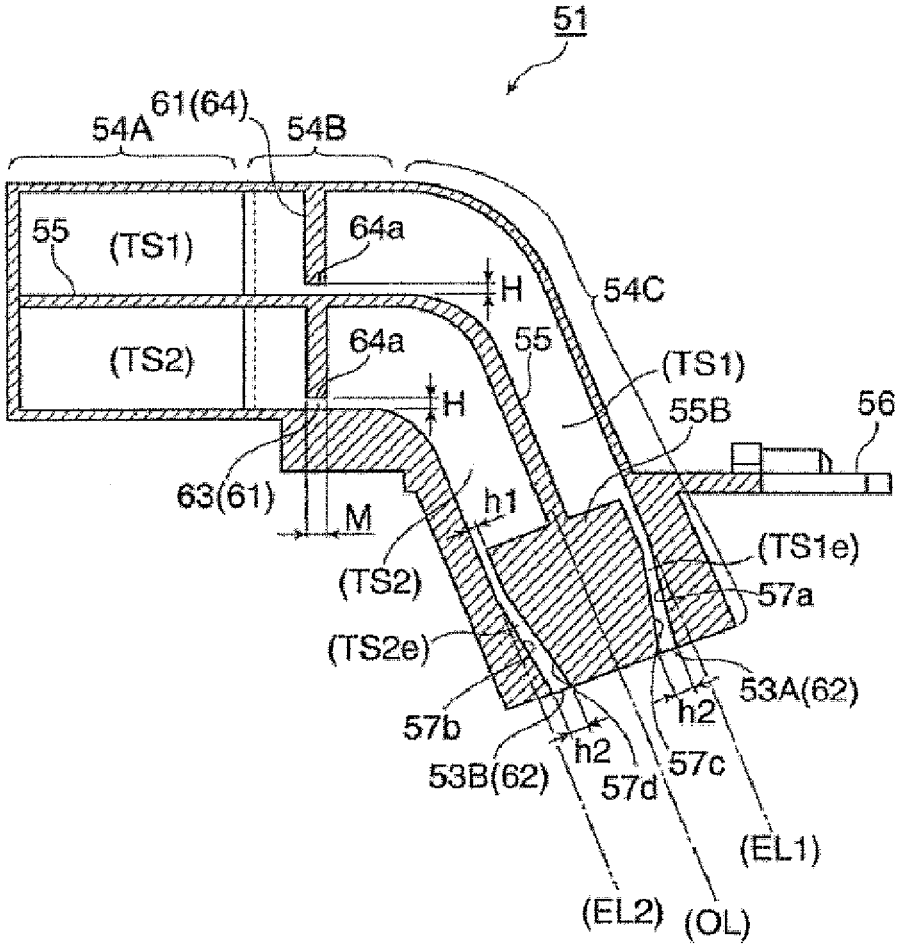
FIG. 8 is a cross-sectional view along line Q-Q of the blower duct of FIG. 4.

In Exemplary Embodiment 1, the passage space TS1*e* or TS2*e* that determine the emission direction of air, are provided in a part of a form that extends substantially in the shape of a straight line on the downstream side of the second bent flow path 54C. That is, the passage space TS1*e* or TS2*e*, as shown in FIG. 8 or the like, is formed in such a shape such that the overall passage thereof has a smaller cross-sectional area than the cross-sectional area of each passage space TS1 or TS2, and is set so that the air flow direction on the downstream side of the passage is a direction that inclines inward with respect to each extension line EL1 or EL2 along the outside inner wall surface of the part of each passage space TS1 or TS2 of a form that extend substantially in the shape of a straight line on the downstream side of the second bent flow path 540. Actually, a downstream part of the passage space TS1*e* or TS2*e* is formed in a state where an outside inner wall surface 57*a* or 57*b* in the second bent flow path 54C of the blower duct 51 and an inside inner wall surface 57*c* or 57*d* that is a portion of the partition wall 55 extends so as to incline inward with respect to the extension line EL1 or EL2. Additionally, the outside inner wall surface 57*a* or 57*b* and the inside inner wall surface 57*c* or 57*d* that constitute the downstream part of the passage space TS1*e* or TS2*e*, in other words, the extension line thereof is formed in an obliquely extending manner so as to approach a central extension line OL of the partition wall 55.

Incidentally, the inside inner wall surface 57*c* or 57*d* of the passage space TS1*e* or TS2*e* is formed by a partition wall increasing portion 555 in which the thickness of the partition wall 55 is increased perpendicularly to the outside inner wall surface of each passage space TS1 or TS2 from the midway of the partition wall, and then, is gradually decreased as it goes to the downstream side in an air flow direction (FIG. 8). Additionally, the height h2 of the downstream opening (the opening portion 53A or 53B of the outlet port) of the passage space TS1*e* or TS2*e* is set to a value that is larger than the height h1 of an upstream opening (h2>h1).

Additionally, the passage space TS1*e* or TS2*e*, as shown in FIG. 5 or the like, is set so that the emission direction of air thereof is a direction in which the two corona discharge wires 41A and 41B in the charging device 4 are not present on an extension line of a center scheduled line D in the emission direction. Particularly, in Exemplary Embodiment 1, the emission direction of the passage space TS1*e* or TS2*e* is set so as to be a direction in which air runs against the boundary plate 40*d* of the shielding case 40 while avoiding the two corona discharge wires 41A and 41B in the charging device 4.

The operation of the blowing device 5 will be described below.

If the blowing device 5 arrives at a driving setting timing, such as an image forming operation timing, the blower 50 is first rotationally driven to send out a required volume of air. The air (E) sent from the started blower 50 is taken from each opening portion 52A or 52B that constitutes the inlet port 52 of the blower duct 51 through the connection duct 58 into each passage space TS1 or TS2 that follows the opening portion, in a divided state.

Figure 6:
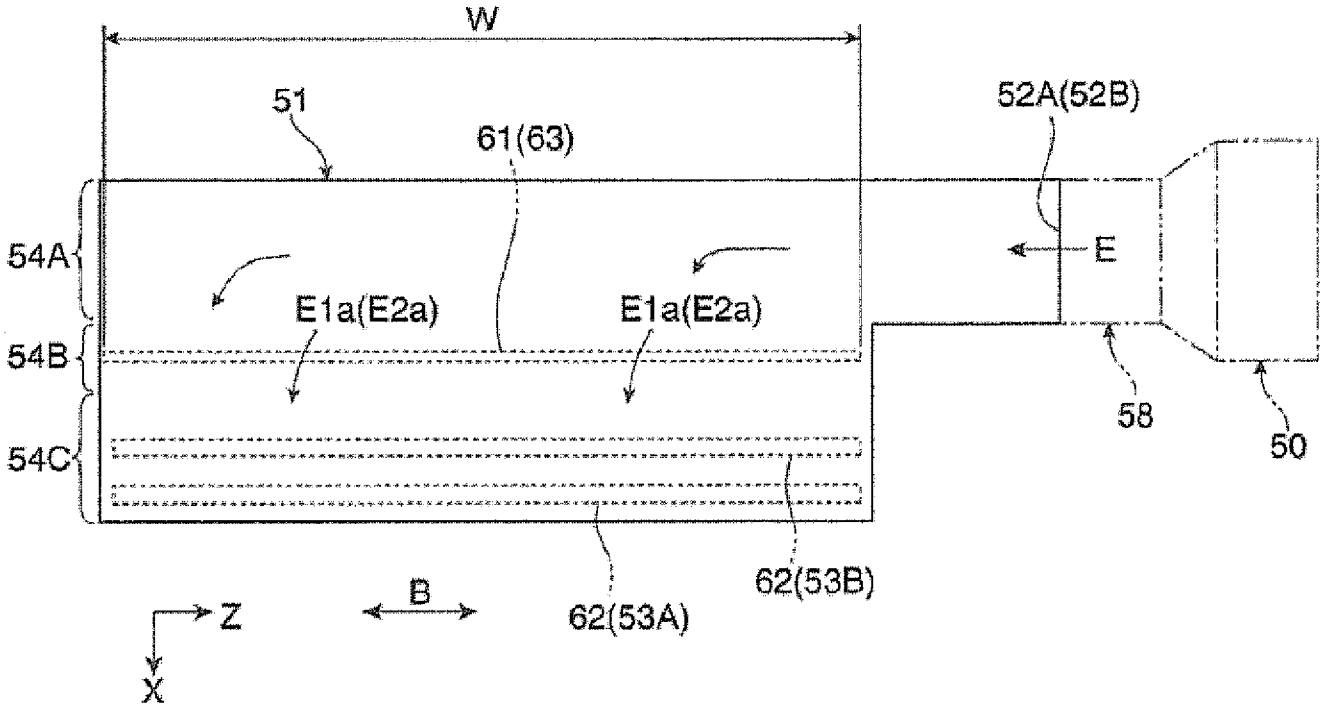
FIG. 6 is a schematic view showing a state when the blowing device of FIG. 3 is seen from above.
Figure 7:
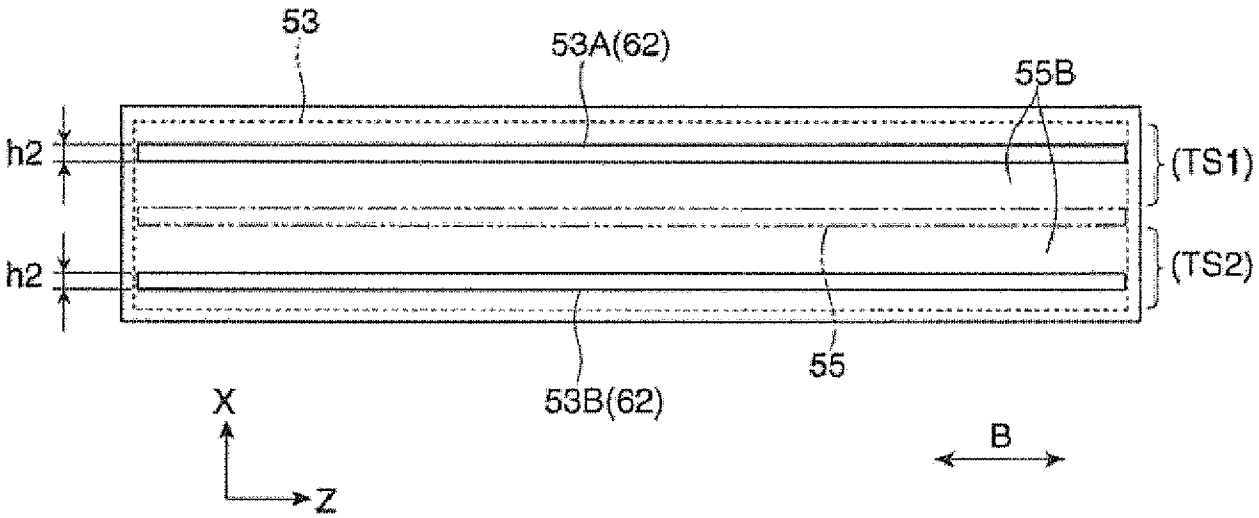
FIG. 7 is a view showing a state when a portion of an outlet port in the blower duct of FIG. 4 is seen from below.
Figure 9:
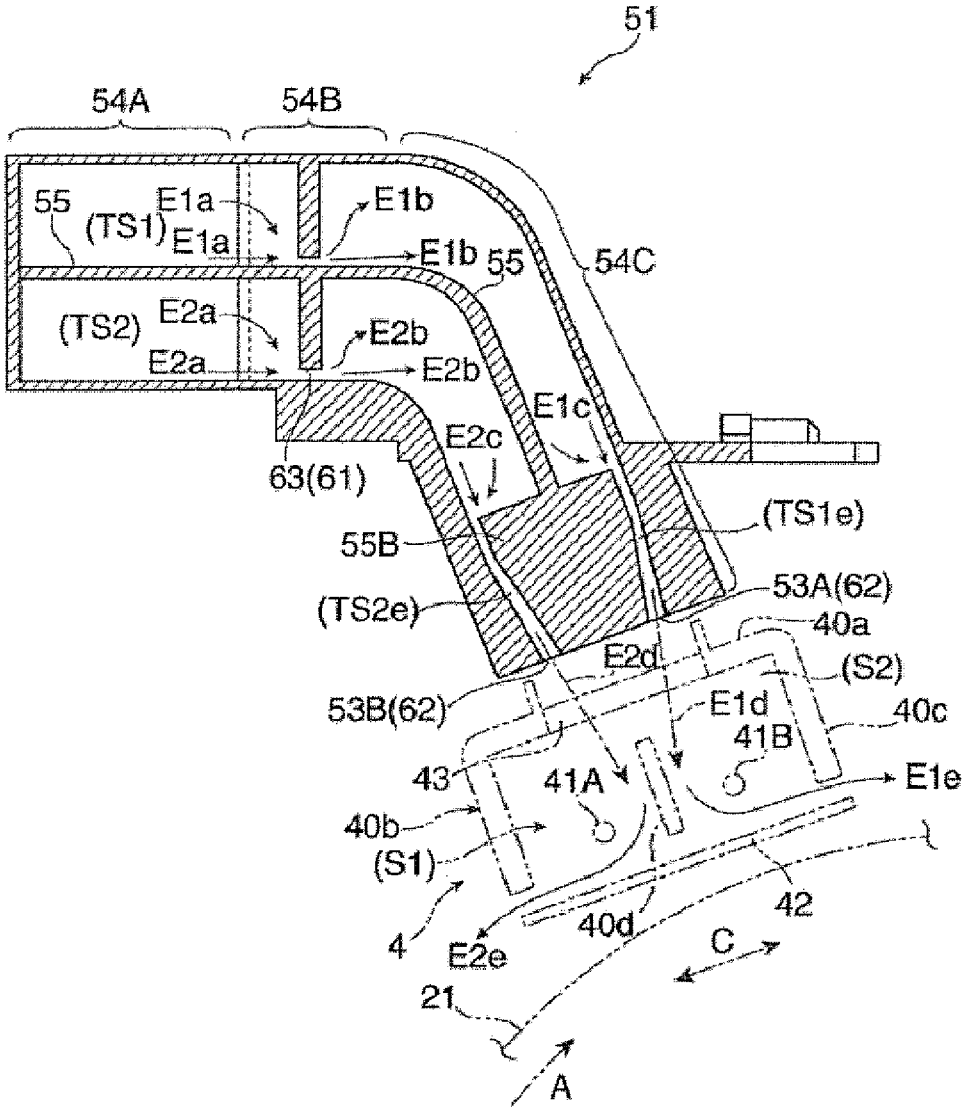
FIG. 9 is an explanatory view showing the operating state or the like of the blowing device related to Exemplary Embodiment 1.

Subsequently, the air (E) taken into the blower duct 51, as shown in FIG. 6 or 9, is sent so as to flow into each passage space TS1 or TS2 of the first bent flow path 545 through each passage space TS1 or TS2 of the introduction flow path 54A (refer to arrow E1*a* or E2*a*). The air (arrow E1*a* or E2*a*) sent into each passage space TS1 or TS2 of the first bent flow path 54B passes through the gap 63 of the upstream flow control member 61, and proceeds in a state where the proceeding direction (direction in which air flows) thereof is changed to an almost right-angled direction.

In this case, the air (E1*a* or E2*a*) when passing through the gap 63 of the first upstream flow control member 61 in each passage space TS1 or TS2 of the first bent flow path 54B has its flow suppressed by passing through the narrow gap 63 of the flow control member 61 (the pressure of the air is raised), and tends to flow out of the gap 63 in a uniform state. Moreover, as for the air (E1*a* or E2*a*) that passes through the gap 63 of the flow control member 61, the direction of the air when flowing out of the gap 63 is aligned with a direction substantially orthogonal to the longitudinal direction (B) of the outlet port 53.

Next, the air (E1*b* or E2*b*) after passing through the gap 63 of the flow control member 61 in each passage space TS1 or TS2 of the first bent flow path 54B, moves to each passage space TS1 or TS2 of the second bent flow path 54C that is continuous in the state of being bent at a substantially right angle downward from the first bent flow path 54B.

Subsequently, the air (E1*b* or E2*b*), which has flown into each passage space TS1 or TS2 of the second bent flow path 54C, flows into each passage space TS1 or TS2 of the second bent flow path 54C whose volume is relatively larger than each passage space TS1 and TS2 of the introduction flow path 54A or the space of the gap 63 of the flow control member 61, and thereby stagnates temporarily so as to be diffused within each passage space TS1 or TS2 of the second bent flow path 54C, and the unevenness of the wind speed is reduced.

Lastly, the air (E1*c* or E2*c*) that has stagnated temporarily in each passage space TS1 or TS2 of the second bent flow path 54C, passes the passage space TS1*e* or TS2*e* and the opening portion 53A or 53B of the outlet port that determines the emission direction of air as the most downstream flow control member 62 provided in a portion ranging from the downstream part of the bent flow path 54C to the opening portion 53A or 53B that constitutes the outlet port 53, and as shown by arrow E1*d* or E2*d* in FIG. 9, is emitted to the outside of the blower duct 51 from the opening portion 53A or 53B of the outlet port.

In this case, the air (E1*d* or E2*d*) emitted from the opening portion 53A or 53B of the outlet port 53 passes through the passage space TS1*e* or TS2*e* with a cross-sectional area that is relatively smaller than the cross-sectional area of the upstream part of each passage space TS1 or TS2 of the second bent flow path 54C, and the opening portion 53A or 53B of the outlet port, and is sent out in a state where the flow of the air is suppressed (the pressure is raised also at this time). Additionally, the air (E1*d* or E2*d*) at this time is sent out in a state where the proceeding direction (emission direction) thereof is regulated (guided) to a direction that is slightly directed to the inside from the opening portion 53A or 53B of the outlet port 53.

From the above, the air (E1*d* or E2*d*) emitted from the blower duct 51 is emitted in a substantially equally distributed state from the opening portion 53A or 53B, and is emitted in a state where the wind speed thereof is substantially uniform in the longitudinal direction (B) of the opening shape (elongated oblong shape) of the opening portion 53A or 53B. Additionally, the air (E1*d* or E2*d*) at this time is emitted toward a desired direction as described above.

Then, the air (E1*d* or E2*d*) emitted from the opening portion 53A or 53B of the outlet port 53 of the blower duct 51 in the blowing device 5 is blown into the internal space (S1 or S2) of the shielding case 40 through the opening portion 43 in the top plate 40*a* of the shielding case 40 of the charging device 4.

In this case, the air (E1*d* or E2*d*) is emitted at a substantially uniform wind speed in the longitudinal direction of the opening portion 53A or 53B, and is blown into the internal space (S1 or S2). Additionally, the air (E1*d* or E2*d*), as shown in FIG. 9, is emitted particularly through a downstream portion of the passage space TS1*e* or TS2*e* that determines the emission direction of air, and is thereby blown out so as to run against the boundary plate 40*d* of the shielding case 40 without strongly hitting the two corona discharge wires 41A and 41B in the internal spaces S1 and S2 of the shielding case 40 (FIG. 9).

Thereby, the air (E1*d* or E2*d*) blown into the internal space (S1 or S2) of the shielding case 40, as illustrated by an arrow E1*e* or E2*e* in FIG. 9, hits the grid electrode 42 after running against the boundary plate 40*d*, proceeds so that most thereof escapes through the opening of the grid electrode 42 or escapes through the gap between a lower end portion in the lateral portion 40*b* or 40*c* of the shielding case 40 and the grid electrode 42, and thereby moves so as to be finally emitted to the outside of the shielding case 40.

As a result, since the air (E1*d* or E2*d*) emitted from the blower duct 51 moves so as to pass by the two corona discharge wires 41A and 41B within the internal spaces (S1 or S2) of the shielding case 40 and is emitted to the outside of the shielding case 40, unnecessary substances, such as discharge products, paper debris, and an external additive of toner, which are going to adhere to the grid electrode 42 may be kept away from the two discharge wires 41A and 41B, and may be discharged to the outside of the shielding case 40. Additionally, since the air (E1*d* or E2*d*) emitted from the blower duct 51 is not directly and strongly blown against the two corona discharge wires 41A and 41B, the air does not vibrate the corona discharge wires 41A and 41B unnecessarily.

Accordingly, since the charging performance of the charging device 4 may be kept from deteriorating wholly or partially due to sparse adhesion of unnecessary substances to the discharge wires 41A and 41B or the grid electrode 42 and vibration of the discharge wires 41A and 41B, it is possible to more uniformly charge the peripheral surface of the photoconductor drum 21. Additionally, a toner image formed in the image forming unit 20 including the charging device 4, and an image finally formed on a sheet 9, are excellent images in which the occurrence of image defects (uneven density or the like) resulting from charging defects, such as uneven charging and deterioration of charging performance, is suppressed.

Figure 10:
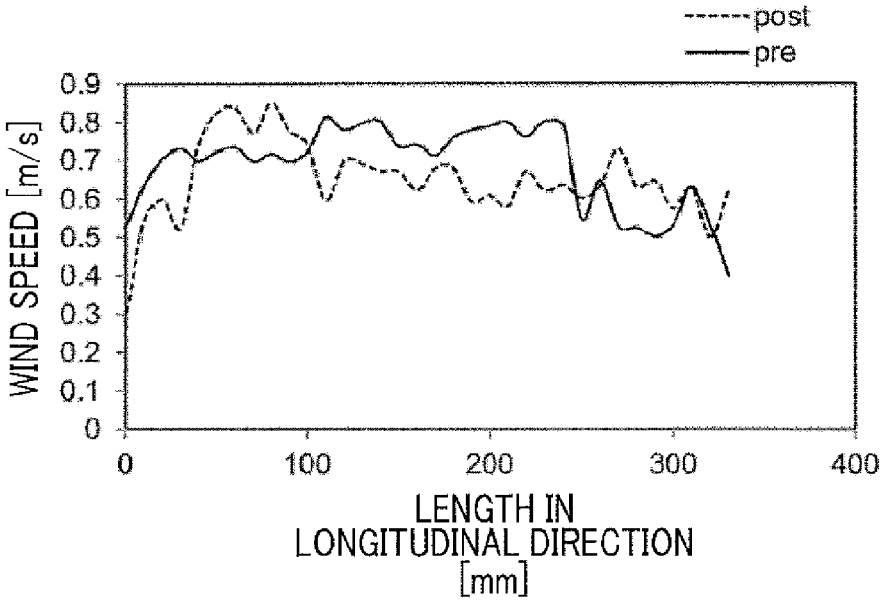
FIG. 10 is a graph chart showing the results of an evaluation test regarding the performance characteristics of the blowing device (blower duct) related to Exemplary Embodiment 1.

FIG. 10 shows the results of an evaluation test when the performance characteristics (wind speed distribution of air emitted from the blower duct 51) of the blowing device 5 are investigated.

Regarding the test, air with an average air volume of 0.33 $m^3$/min is introduced from the blower 50, and then, the wind speed (wind speed in the entire region of each opening portion in the longitudinal direction B) of the air blown out from the opening portion 53A or 53B of the outlet port 53 of the blower duct 51 is measured. The measurement is performed by using an air speedometer (F900 made by Cambridge AccuSense, Inc.), and as shown in FIG. 9, moving the air speedometer in the longitudinal direction B in two locations including the position (pre-position) of the opening portion 53A located on the upstream side in the rotational direction A of the photoconductor drum 21, and the position (post-position) of the opening portion 54B located on the downstream side in the rotational direction A of the photoconductor drum 21.

As the blower duct 51, there is used a blower duct in which the overall shape is that as shown in FIGS. 3 to 9, the inlet port 52 is constituted by the two opening portions 52A and 52B having an oblong opening shape of 22 mm×11 mm, and the outlet port 53 is constituted by the two opening portions 53A and 53B having an elongated oblong opening shape of 2 mm×350 mm. The thickness of the partition wall 55 is 2 mm. The opening portions 53A and 53B have a positional relationship in which the opening portions are apart from each other by 4 mm. Additionally, the upstream flow control member 61 is configured by arranging a substantially flat-plate partition member 64, so that a gap 63, in which the height H is 1.5 mm, the path length M is 8 mm, and the width W is 345 mm, is present. Moreover, as the passage space TS1*e* or TS2*e* in the second bent flow path 54C of the blower duct 51, a passage space is adopted, in which the height h1 of the upstream opening thereof is about 10 mm, the passage length thereof is 10 mm, and the downstream portion thereof is formed in a shape that extends in a direction that inclines inward at an angle of about 30°.

As shown in FIG. 10, the wind speed in the longitudinal direction (B) of the two opening portions 53A and 53B that constitute the outlet port 53 of the blower duct 51 has a value near about 0.5 to 1.5 m/sec that is the mean wind speed of a target value substantially over the whole region in the longitudinal direction, or a value that is equal to or more than the above value, and the wind speed in the longitudinal direction B of the opening portions 53A and 53B is brought into a substantially uniform state. Additionally, it may be seen that the results of the respective wind speeds in the opening portion 53A and the opening portion 53B are almost the same value, and thereby, air is emitted in the state of being distributed in substantially equal proportions from the two opening portions 53A and 53B that constitute the outlet port 53, without being biased to one of the opening portions. Incidentally, in FIG. 10, the left end (0 mm) of the horizontal axis is an end portion near the inlet port 52 out of the outlet port 53 of the blower duct 51.

Figure 20:
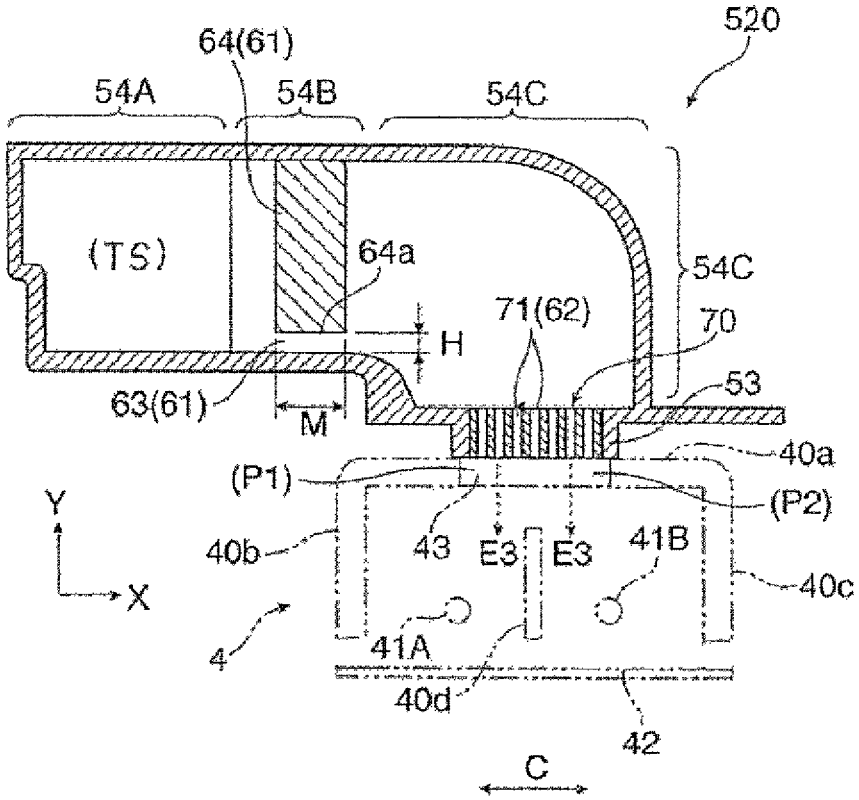
FIG. 20 is a cross-sectional explanatory view showing the configuration or the like of main portions of a blower duct of a comparative example.

Here, for reference, a blower duct 520 as a comparative example is shown in FIG. 20.

In a case where the blower duct 520 is compared with the blower duct 51 in Exemplary Embodiment 1, the blower duct 520 is different from the blower duct 51 in that the passage space TS of the flow path 54 is not divided by the partition wall 55, and the most downstream flow control member 62 is changed to a state where a permeable member 70 having plural ventilation portions 71 is installed in the outlet port 53 to bring the outlet port into a closed state, and has the same components as those of the blower duct 51 in terms of the other configuration. In addition, although there is a difference in that the length of the second bent flow path 54C after being bent downward becomes short, this difference hardly affects the flow direction and emission method of air (almost the same).

Incidentally, the upstream flow control member 61 has almost the same configuration as the flow control member 61 in Exemplary Embodiment 1. Additionally, the plural ventilation portions 71 in the permeable member 70 that constitutes the most downstream flow control member 62 are through holes that extend so that each opening shape is substantially circular and penetrates in the shape of a straight line. Additionally, the plural ventilation portions 71, for example, are arranged at regular intervals along the longitudinal direction (B) of the opening shape of the outlet port 53, and are arranged so as to be present in four rows at the same intervals as the above regular intervals also in the lateral direction C orthogonal to the longitudinal direction. Thereby, the plural ventilation holes 71 are formed so as to be dotted throughout the passage space of the terminating end of the second bent flow path 54C or the opening shape of the outlet port 53.

Then, the evaluation test of the performance characteristics in Exemplary Embodiment 1 is similarly performed using the blower duct 520. The test results are shown in FIG. 21.

The blower duct 520 used in this evaluation test is a blower duct in which the inlet port 52 has a substantially square opening shape of 22 mm×23 mm, and the outlet port 53 has an oblong opening shape of 17.5 mm×350 mm. Additionally, the upstream flow control member 61 is configured so that the height H of the gap 63 is about 1.5 mm, the path length M is 8 mm, and the width W is 345 mm. Moreover, the most downstream flow control member 62 is configured using the permeable member 70 in which the ventilation holes 71 with a hole diameter of 1 mm and a length of 3 mm are provided under the condition that the density of the holes is 0.42 pieces/$mm^2$ (≅42 pieces/$cm^2$).

Figure 21A:
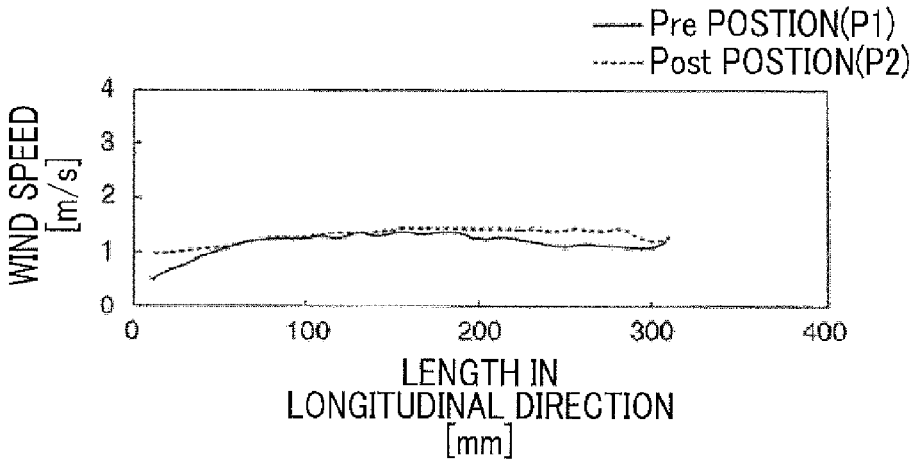
FIGS. 21A and 21B show an evaluation test regarding the performance characteristics of the blower duct of FIG. 20.
Figure 21B:
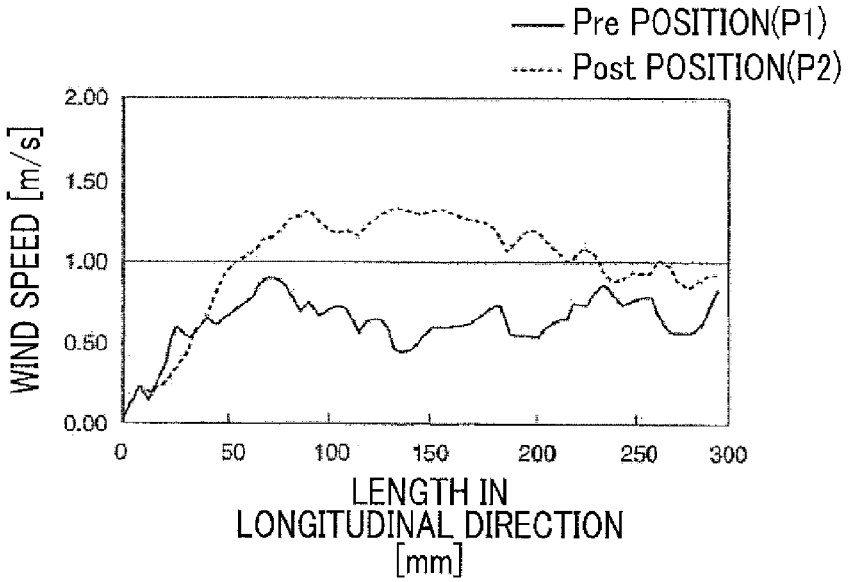

FIG. 21A shows test results when air of which the average air volume is 0.25 $m^3$/min is introduced from the inlet port 52. In this case, the wind speed of the air (arrow E3) that comes out from the outlet port 53 is brought into a substantially uniform state in the longitudinal direction B of the opening shape (oblong shape) of the outlet port 53, and is brought into a substantially uniform state also in the lateral direction C. FIG. 21B shows test results when air of which the average air volume is 0.33 $m^3$/min is introduced from the inlet port 52. In this case, an uneven (difference) state is brought also in the lateral direction C in addition to being brought into an uneven state in the longitudinal direction B of the opening shape of the outlet port 53. As for the wind speed in the lateral direction C, the wind speed on the Post-position side is increased compared to the wind speed on the Pre-position side. That is, in the blower duct 520, it may be seen that, in a case where the air volume of air taken in from the inlet port 52 is increased (for example, in a case where the air volume is made equal to or more than 0.35 $m^3$/min), relatively fast air is emitted from the Post-position side of the outlet port 53, and the air tends to be biased.

In contrast, in the blower duct 51 related to Exemplary Embodiment 1, as is clear from the results shown in FIG. 10, air of almost the same wind speed is emitted from the two opening portions 53A and 53B that constitute the outlet port 53 even in a case where air of which the average air volume is 0.33 $m^3$/min is introduced from the inlet port 52.

Figure 11:
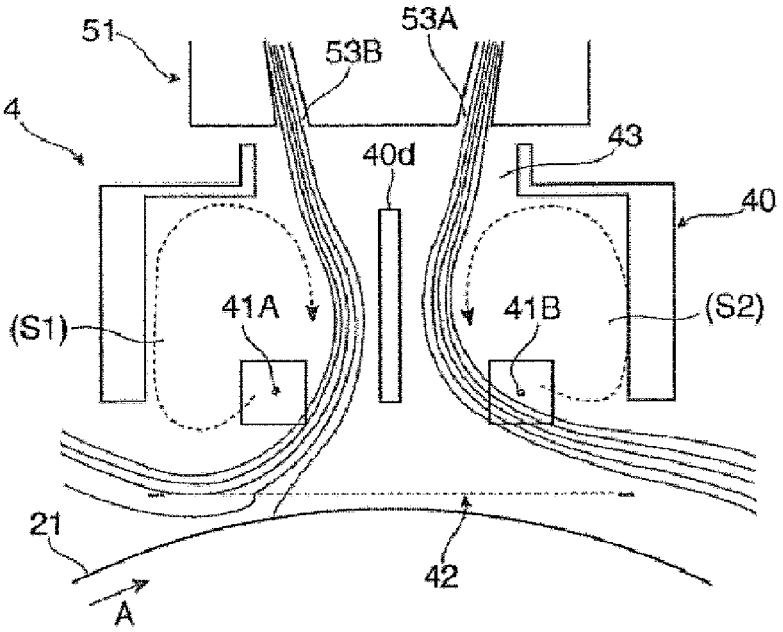
FIG. 11 is a streamline view showing the results when the blowing state of air of the blowing device (blower duct) related to Exemplary Embodiment 1 to the charging device is simulated.

FIG. 11 shows the results when the emission state of air of the blower duct 51 related to Exemplary Embodiment 1 to the charging device 4 is simulated. FIG. 11 is a streamline view expressing the state of a main flow of air when being emitted from the opening portions 53A and 53B of the outlet port of the blower duct 51 and blown into the internal spaces of the shielding case 40 of the charging device 4 in lines. Additionally, square shapes in the drawing are virtual frames showing that the discharge wires 41A and 41B equivalent to actual thickness are present at centre positions (points) thereof. In addition, air that is actually flowing is present also at peripheries shown by solid lines. The condition setting of the simulation is performed including the conditions shown in the above evaluation test.

As shown in FIG. 11, according to the blower duct 51 related to Exemplary Embodiment 1, when air emitted from the opening portions 53A and 53B of the outlet port is blown into the internal spaces of the shielding case 40, the air proceeds in the direction in which the air collides against the boundary plate 40*d*, then passes through the vicinities of the discharge wires 41A and 41B (space portions where the boundary plate 40*d* is present), passes through space portions below the discharge wires, and passes through the grid electrode 42 or is emitted to the outside of the shielding case 40 through gaps between lower portions of the lateral portions of the shielding case 40 and the grid electrode 42. Additionally, in the blower duct 51, a portion of air blown into the shielding case 40 is circled in the internal spaces (S1 or S2) of the shielding case 40 as illustrated by dotted-line arrows in FIG. 11. In any case, in the blower duct 51, air emitted from the opening portions 53A and 53B of the outlet port is not strongly blown directly against the two discharge wires 41A and 42B.

Figure 22:
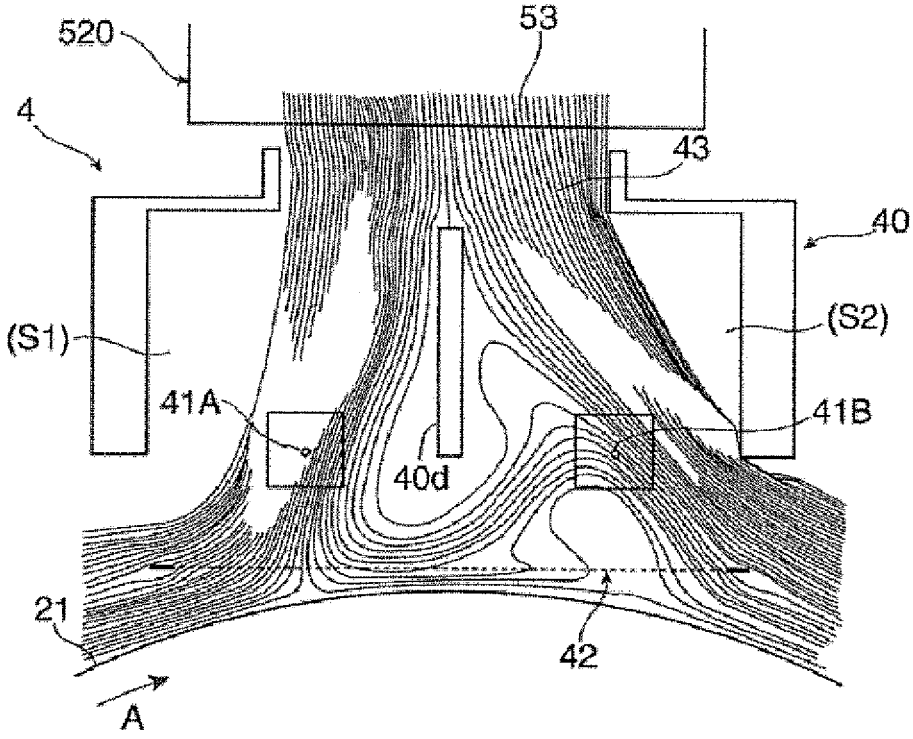
FIG. 22 is a streamline view showing the results when the blowing state of air of the blowing device to which the blower duct of the comparative example is applied, to the charging device, is simulated.

Additionally, the results when the emission state of air of the blower duct 520 related to the above comparative example to the charging device 4 is simulated are shown in a streamline view in FIG. 22 for reference. In this case, as for the introduction amount of air from the inlet port 52, a case where the average air volume is 0.33 $m^3$/min is set. In the blower duct 520, air emitted from the through holes 71 of the permeable member 70 that covers the outlet port 53 is blown directly against the two discharge wires 41A and 42B. Incidentally, the air blown against the discharge wire 41B at the Post-position flows so as to pass through a position (space on the left-hand side of the wire 41B in FIG. 22) slightly shifted from the discharge wire 41B under the influence of an airstream caused by the rotation of the photoconductor drum 21 in the direction of arrow A. Additionally, although FIG. 22 shows that lines showing the emission state of air that is simulated from the internal spaces (S1 or S2) of the shielding case 40 to the lower outside are broken, these broken portions are portions in which the illustration of the lines is omitted halfway, and actually, lines that are present between broken upper end portions and lower end portions of the lines are continuous in proximity with each other, similar to the other streamline views (FIGS. 11, 14A and 14B, and 16).

Exemplary Embodiment 2

Figure 12:
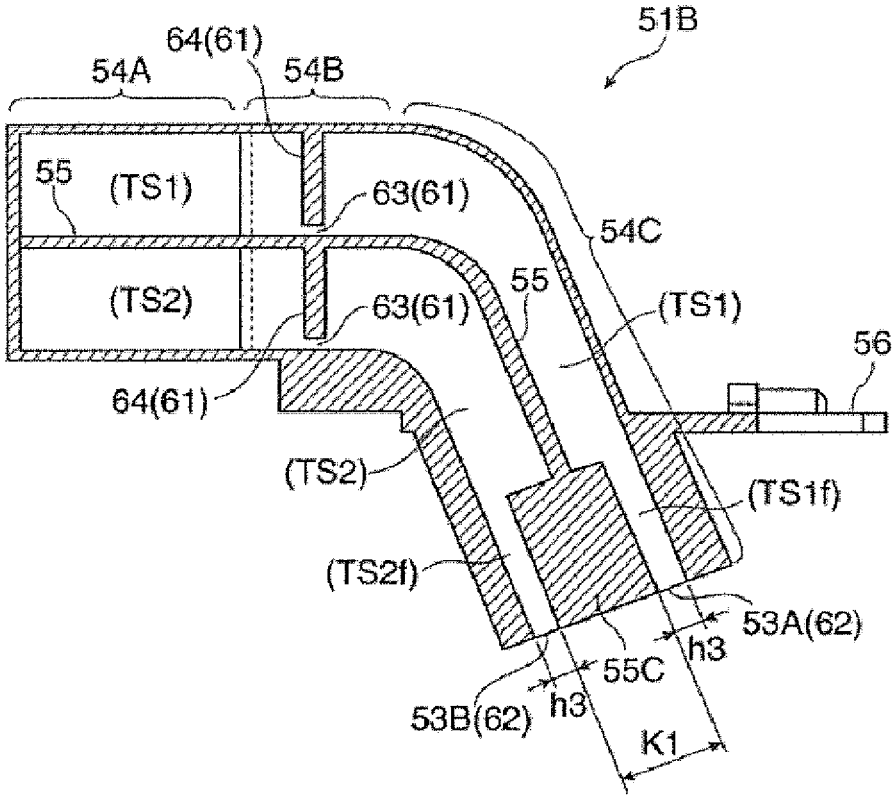
FIG. 12 is a cross-sectional view showing a configuration example of a blower duct in a blowing device related to Exemplary Embodiment 2.
Figure 13:
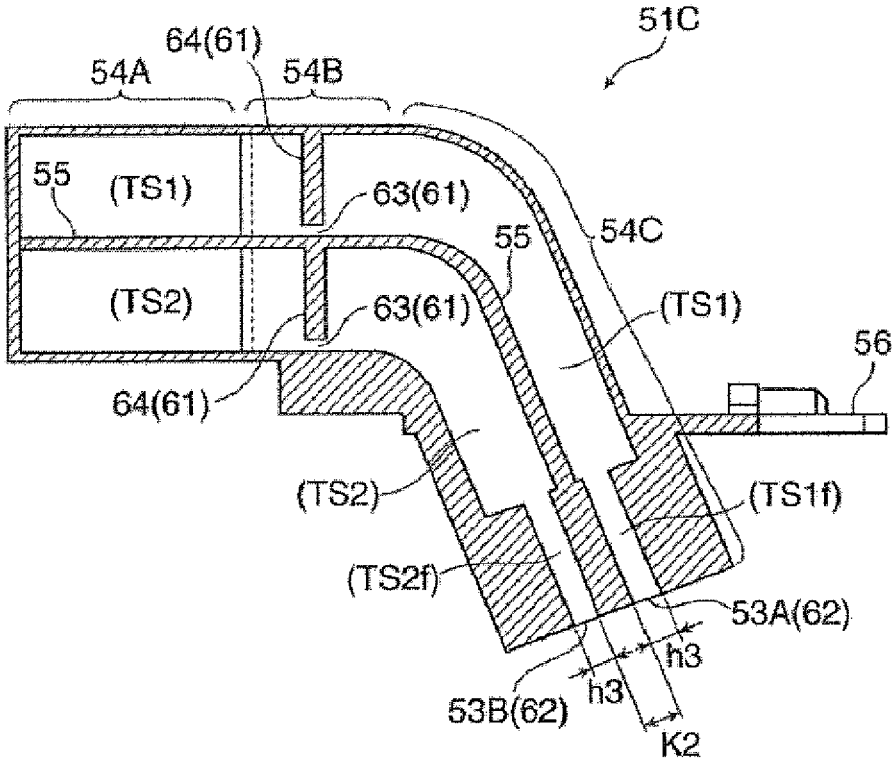
FIG. 13 is a cross-sectional view showing another configuration example of the blower duct in the blowing device related to Exemplary Embodiment 2.

FIGS. 12 and 13 show blower ducts 51B and 51C related to Exemplary Embodiment 2.

The blower duct 51B shown in FIG. 12 has the same configuration as the blower duct 51 in Exemplary Embodiment 1 except that the configuration of the most downstream flow control member 62 is changed. In the subsequent description portions and drawings, common constituent elements are designated by the same reference numerals, and the description of the constituent elements is omitted except when necessary.

That is, the most downstream flow control member 62 in the blower duct 51B is configured by forming a passage space TS1*f* or TS2*f* of a straight-line shape having a smaller cross-sectional area than the cross-sectional area of each passage space TS1 or TS2 of the second bent flow path 54C. The passage space TS1*f* or TS2*f* is formed in a shape that extends linearly so that the overall passage thereof is parallel to the extension line (EL1, EL2: refer to FIG. 8) along the outside inner wall surface of the part of each passage space TS1 or TS2 of a form that extends substantially in the shape of a straight line on the downstream side of the second bent flow path 54C.

Incidentally, the inside inner wall surface (57*c*, 57*d*: refer to FIG. 8) of the passage space TS1*f* or TS2*f*, substantially similar to the case of the passage space TS1*e* or TS2*e* in Exemplary Embodiment 1, is formed by a partition wall increasing portion 55C of a form in which the thickness of the partition wall 55 is increased so as to be orthogonal to the outside inner wall surface of each passage space TS1 or TS2 from the midway of the partition wall, and then is continuous with the same increasing amount to the downstream side in the air flow direction. Additionally, the height h3 of the downstream opening (the opening portion 53A or 53B of the outlet port) of the passage space TS1*f* or TS2*f* is set to a value that is the same as the height of the upstream opening.

Additionally, the passage space TS1*f* or TS2*f* is set so that the emission direction of air thereof is a direction in which the two corona discharge wires 41A and 41B in the charging device 4 are not present on the extension line of the center scheduled line D (FIG. 14A) in the emission direction. Specifically, the passage spaces are set in directions that pass through the insides of the two discharge wires 41A and 41B. The opening portion 53A or 53B of the outlet port that is a termination end of the passage space TS1*f* or TS2*f* is an elongated oblong shape whose opening shape is parallel to the longitudinal direction B of the charging device 4, and both the opening portions are set at positions apart from each other by a distance K1 (for example, 10 mm).

The blower duct 51C shown in FIG. 13 has the same configuration as the blower duct 51B shown in FIG. 12 except that a change is made in which that the interval K2 between the passage spaces TS1*f* and TS2*f* that constitute the most downstream flow control member 62 is narrowed. That is, in the blower duct 51C, the interval K2 between the passage spaces TS1*f* and TS2*f* is set to a value (K2<K1: for example, 3 mm) that is smaller than the interval K1 in the blower duct 51B shown in FIG. 12.

Figure 14A:
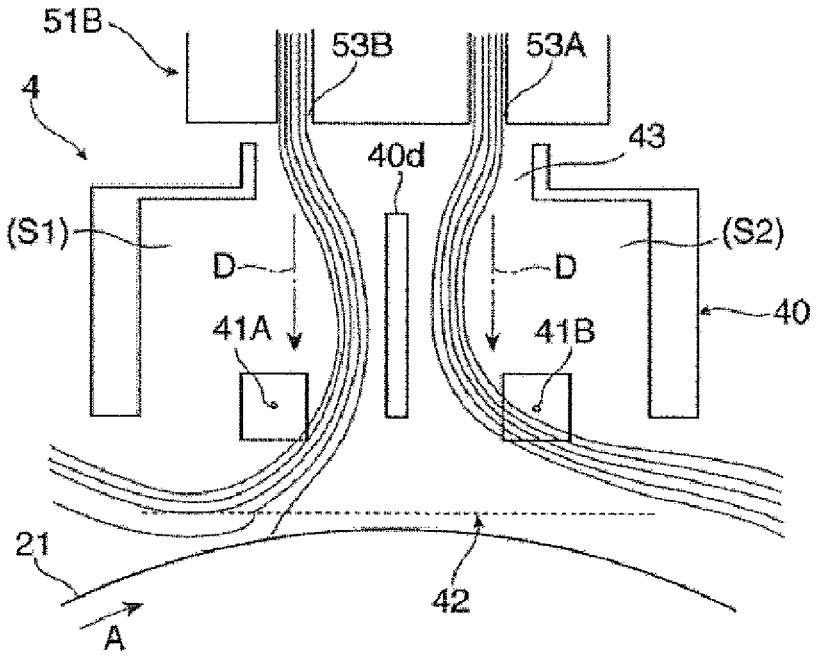
FIGS. 14A and 14B show the results when the blowing state of air of the blowing device (two sorts of blower ducts) related to Exemplary Embodiment 2 to the charging device is simulated.
Figure 14B:
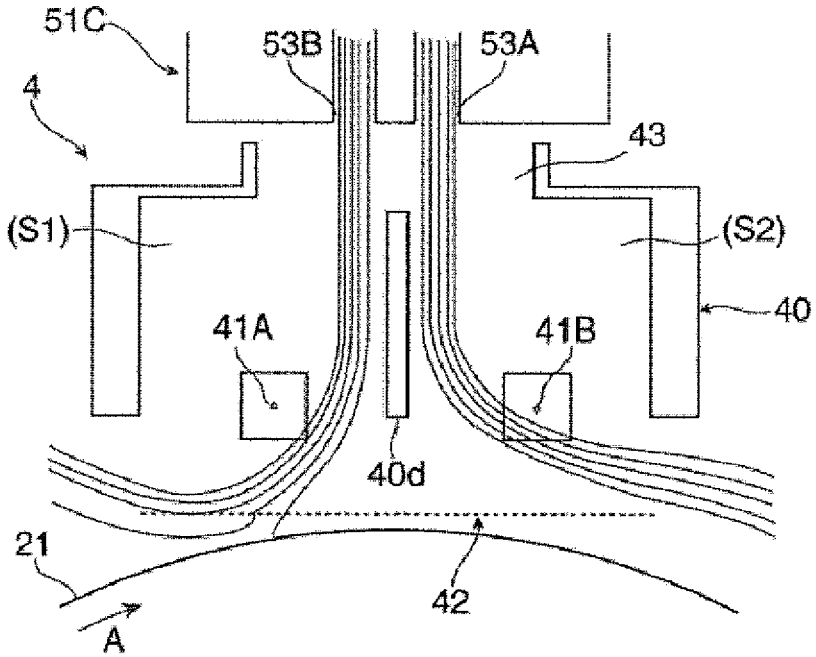

FIGS. 14A and 14B show the results when the emission state of air of the blower ducts 51B and 51C related to Exemplary Embodiment 2 to the charging device 4 is simulated. In this simulation, the condition setting of the passage spaces TS1*f* and TS2*f* in the second bent flow path 54C is the same condition setting of the simulation in Exemplary Embodiment 1 except that the height h3 of the overall passage is 2 mm, the passage length is 15 mm, and the interval K1 between the passage spaces TS1*f* and TS2*f* is 10 mm, and the interval K2 is 3 mm.

In the case of the blower duct 51B, as shown in FIG. 14A, when air emitted from the opening portions 53A and 53B of the outlet port is blown into the internal spaces of the shielding case 40, the air proceeds in a meandering manner so as to be curved to the side approaching the boundary plate 40*d* rather than proceeding linearly along the linear directions of the passage spaces TS1*f* and TS2*f* (center scheduled lines D), then passes through the vicinities of the discharge wires 41A and 41B (space portions where the boundary plate 40*d* is present), passes through space portions below the discharge wires, and passes through the grid electrode 42 or is emitted to the outside of the shielding case 40 through gaps between lower portions of the lateral portions of the shielding case 40 and the grid electrode 42. For this reason, also in the blower duct 51B, air emitted from the opening portions 53A and 53B of the outlet port is barely blown strongly and directly against the two discharge wires 41A and 42B. In addition, it is inferred that the phenomenon in which the air emitted from the opening portions 53A and 53B of the outlet port in the blower duct 51B does not proceed linearly along the linear directions (center scheduled lines D) of the passage spaces TS1*f* and TS2*f* but proceeds in a meandering manner to the side approaching the boundary plate 40*d* is, for example, influenced by the uneven distribution of pressure caused by the rotation of the photoconductor drum 21, the uneven distribution of the whole internal pressure of the housing 10 caused by component parts (devices) arranged around the charging device 4, or the like.

In the case of the blower duct 51C, as shown in FIG. 14*b*, when air emitted from the opening portions 53A and 53B of the outlet port is blown into the internal spaces of the shielding case 40, the air proceeds linearly in a state where the air has approached the boundary plate 40*d*, then passes through the vicinities of the discharge wires 41A and 41B (space portions where the boundary plate 40*d* is present), passes through space portions below the discharge wires, and passes through the grid electrode 42 or is emitted to the outside of the shielding case 40 through gaps between lower portions of the lateral portions of the shielding case 40 and the grid electrode 42. For this reason, also in the blower duct 51C, air emitted from the opening portions 53A and 53B of the outlet port is barely blown strongly and directly against the two discharge wires 41A and 42B.

Exemplary Embodiment 3

Figure 15:
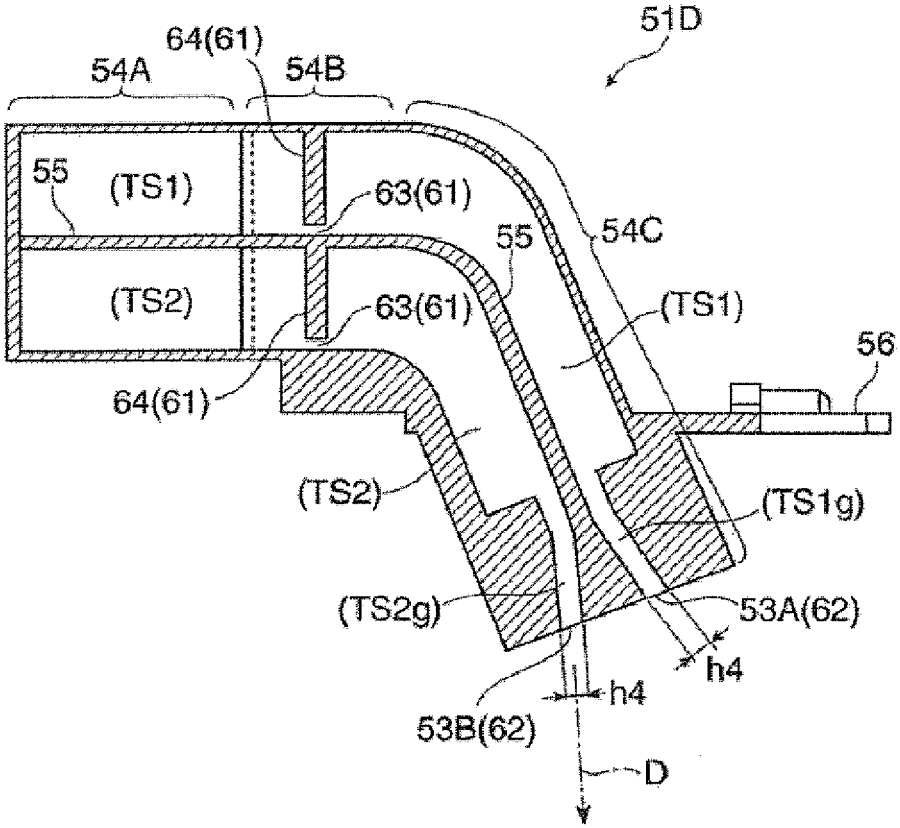
FIG. 15 is a cross-sectional view showing a blower duct in a blowing device related to Exemplary Embodiment 3.

FIG. 15 shows a blower duct 51D related to Exemplary Embodiment 3.

The blower duct 51D has the same configuration as the blower duct 51 in Exemplary Embodiment 1 except that the configuration of the most downstream flow control member 62 is changed.

That is, the most downstream flow control member 62 in the blower duct 51D is configured by forming a passage space TS1*g* or TS2*g* in a shape having a smaller cross-sectional area than the cross-sectional area of each passage space TS1 or TS2 of the second bent flow path 54C and in a shape that is bent so that the air flow direction is directed outward on the downstream side. The passage space TS1*g* or TS2*g* is formed in a shape that extends in a straight line so that an upstream part thereof is parallel to the extension line (EL1, EL2: refer to FIG. 8) along the outside inner wall surface of the part of each passage space TS1 or TS2 of a form that extends substantially in the shape of a straight line on the downstream side of the second bent flow path 54C, and so that a downstream part thereof is formed in a shape that is bent so as to gradually approach the extension line along the outside inner wall surface of the each passage space TS1 or TS2.

Incidentally, the height h4 of the downstream opening (a part that is the opening portion 53A or 53B of the outlet port) of the passage space TS1*g* or TS2*g* is set to a value that is the same as the height of the upstream opening. Additionally, the passage space TS1*g* or TS2*g* is set so that the emission direction of air thereof is a direction in which the two corona discharge wires 41A and 41B in the charging device 4 are not present on the extension line of the center scheduled line D (FIGS. 15A and 15B) in the emission direction. Specifically, the passage spaces are set in directions that pass through the outsides of the two discharge wires 41A and 41B (refer to the flows of air of FIG. 16).

Figure 16:
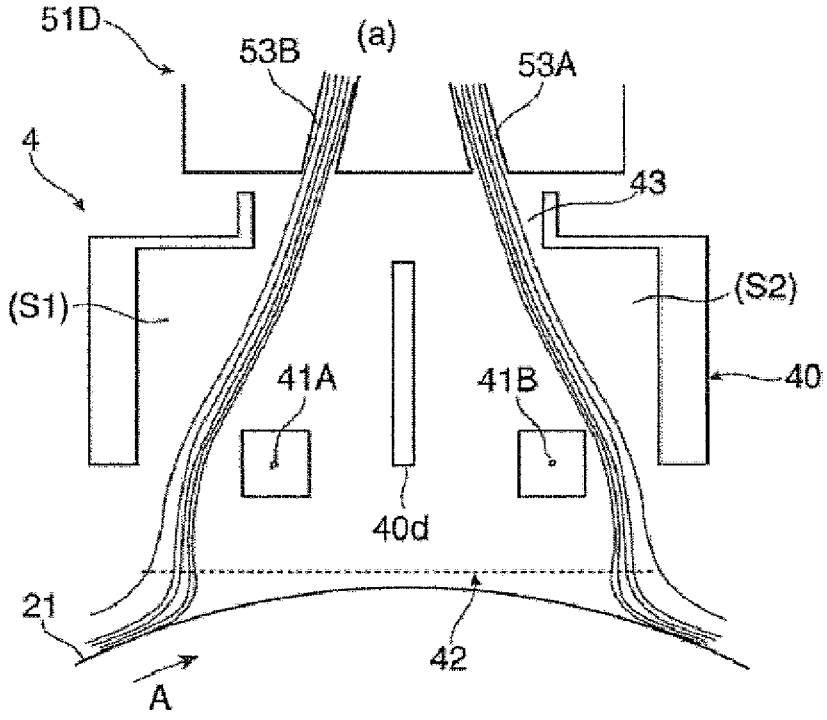
FIG. 16 is a streamline view showing the results when the blowing state of air of the blowing device (blower duct) related to Exemplary Embodiment 3 to the charging device is simulated.

FIG. 16 shows the results when the emission state of air of the blower duct 51D related to Exemplary Embodiment 3 to the charging device 4 is simulated. In this simulation, the condition setting of the passage spaces TS1*g* and TS2*g* in the second bent flow path 54C is the same condition setting of the simulation in Exemplary Embodiment 1 except that the height h4 of the overall passage is 2 mm, the passage length is 15 mm, and the passage spaces TS1*g* and TS2*g* are directed outward at an angle (elevation angle) of about 30° with respect to the centerline of the partition wall 55.

In the case of the blower duct 51C, as shown in FIG. 16, when air emitted from the opening portions 53A and 53B of the outlet port is blown into the internal spaces of the shielding case 40, the air passes through the vicinities of the discharge wires 41A and 41B (space portions where the boundary plate 40*d* is not present), and passes through the grid electrode 42 or is emitted to the outside of the shielding case 40 through gaps between lower portions of the lateral portions of the shielding case 40 and the grid electrode 42. For this reason, also in the blower duct 51D, air emitted from the opening portions 53A and 53B of the outlet port is barely blown strongly and directly against the two discharge wires 41A and 41B.

Exemplary Embodiment 4

Figure 17:
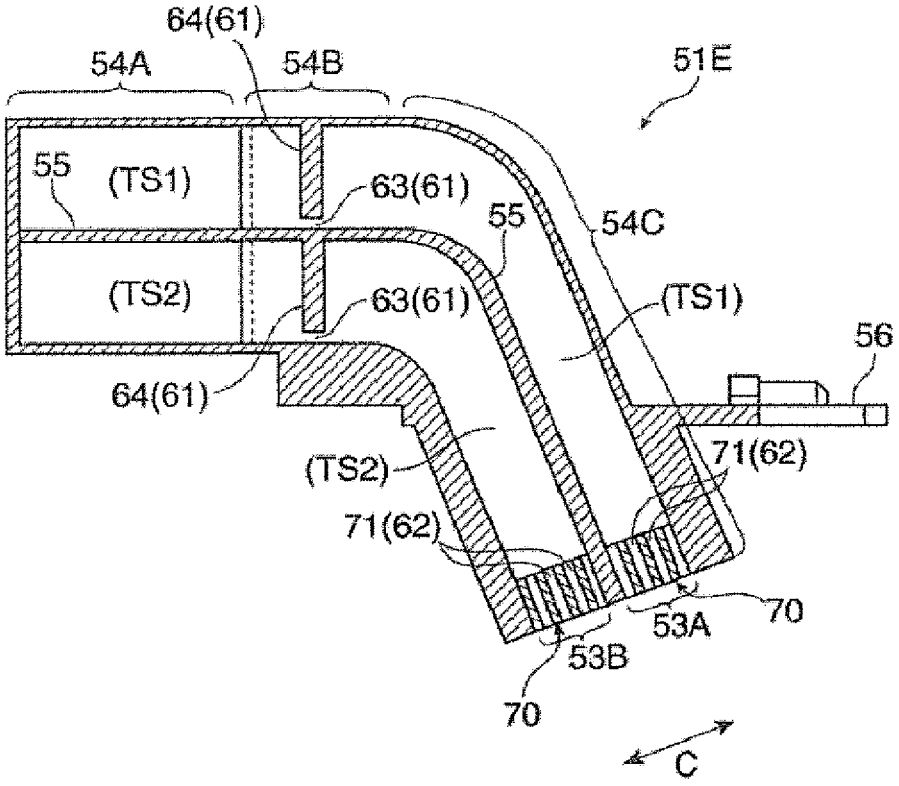
FIG. 17 is a cross-sectional view showing a blower duct in a blowing device related to Exemplary Embodiment 4.

FIG. 17 shows a blower duct 51E related to Exemplary Embodiment 4.

The blower duct 51E has the same configuration as the blower duct 51 in Exemplary Embodiment 1 except that the configuration of the most downstream flow control member 62 is changed.

Figure 18:
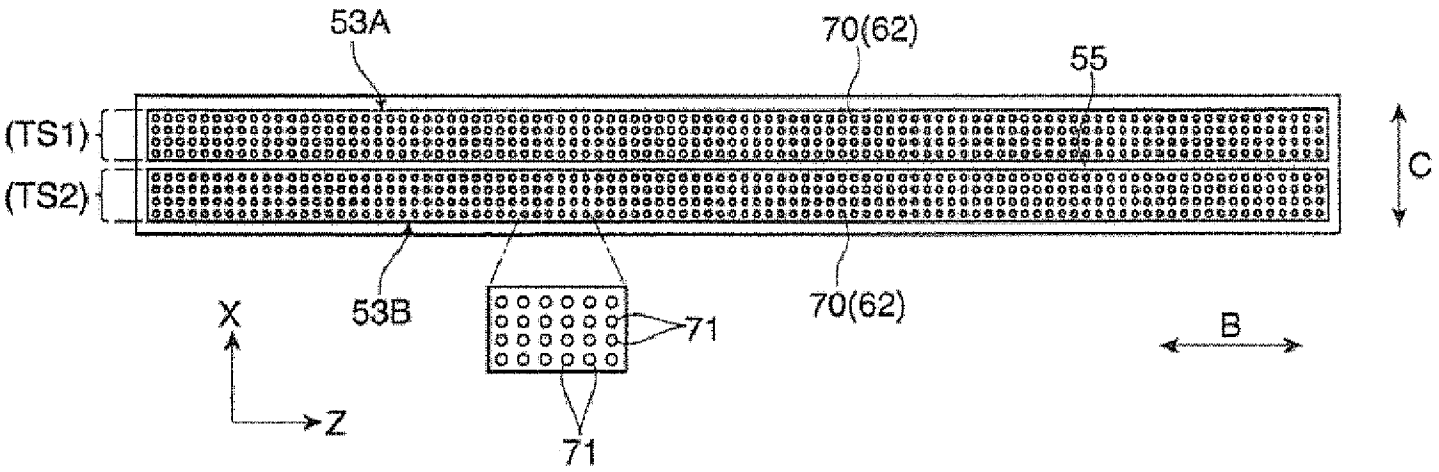
FIG. 18 is a view showing a state when a portion of an outlet port in the blower duct of FIG. 17 is seen from below.

That is, as shown in FIGS. 17 and 18, the most downstream flow control member 62 in the blower duct 51E is configured by installing the permeable member 70 having the plural ventilation portions 71 in each opening portion 53A or 53B of the outlet port of a shape that has the same cross-sectional area as the cross-sectional area of each passage space TS1 or TS2 of the second bent flow path 54C and bringing the opening portion into a closed state.

The plural ventilation portions 71 in the permeable member 70 that constitutes the most downstream flow control member 62 are through holes that extend so that each opening shape is substantially circular and penetrate in the shape of a straight line, as described as a portion of the configuration of the blower duct 520 of the comparative example. Additionally, the plural ventilation portions 71, for example, are arranged at regular intervals along the longitudinal direction (B) of the opening shape including the elongated oblong shape of the opening portion 53A or 533 of the outlet port, and are arranged so as to be present in plural rows at the same intervals as the above regular intervals also in the lateral direction C orthogonal to the longitudinal direction. Thereby, the plural ventilation holes 71 are formed so as to be dotted throughout the passage space of the terminating end of the second bent flow path 54C or each opening portion 53A or 533 of the outlet port. Moreover, it is preferable that the plural ventilation portions 71 be formed so as to be dotted substantially uniformly (in a substantially constant density) in each opening portion 53A or 53B of the outlet port. However, unless the air that comes out from each opening portion 53A or 53B comes out non-uniformly, the ventilation portions may be formed so as to be present in a slightly dense state.

The permeable member 70 in Exemplary Embodiment 4 is a perforated plate that is formed so that the plural ventilation portions (holes) 71 are dotted in a plate-shaped member. The permeable member 70 is formed by being integrally molded from the same material as the blower duct 51E or is formed from a material separate from the blower duct 51E and mounted on each opening portion 53A or 53B of the outlet port. The opening shape, opening dimension, hole length, and hole presence density of the ventilation portions (holes) 71 are selected and set from a viewpoint of making the wind speed of air that has flown out of the second bent flow path 54C through each opening portion 53A or 53B of the outlet port as uniform as possible, and are set in consideration of the dimension (capacity) of the blower duct 51E, the flow rate per unit time of air caused to flow to the blower duct 51E, the charging device 4, or the like.

The blowing device 5 to which the blower duct 51E is applied operates as follows.

The air (E) taken in from the blower 50 flows into the second bent flow path 54C after passing through the introduction flow path 54A, and the first bent flow path 54B provided with the upstream flow control member 61 sequentially, similar to the case of the blower duct 51 related to Exemplary Embodiment 1. Subsequently, in the blower duct 51E, particularly, the air that has flown into and stagnated in the second bent flow path 54C passes through the plural ventilation portions (holes) 71 in the permeable member 70 that constitutes the most downstream flow control member 62 provided in each opening portion 53A or 53B of the outlet port, and is thereby blown out from each opening portion 53A or 53B in a state where the proceeding direction thereof is changed.

In this case, the air blown out from each opening portion 53A or 53B of the outlet port passes through the plural ventilation portions 71 of the permeable member 70 that is relatively narrower than the original opening area (the total cross-sectional area of the passage spaces TS1 and TS2 of the second bent flow path 54C) of the outlet port 53, and is thereby sent out in a state where the flow thereof is suppressed (at this time, the pressure of the air is raised). Additionally, the air blown out from each opening portion 53A or 53B of the outlet port passes through the plural ventilation portions 71 that are dotted throughout each opening portion 53A or 53B of the outlet port and formed on the same conditions, whereby the air is sent out in a uniform state so as to be equivalent to the surface (elongated oblong shape) of a region substantially similar to the opening shape of each opening portion 53A or 53B. Moreover, the air blown out from each opening portion 53A or 53B of the outlet port has its proceeding direction changed to the direction substantially orthogonal to the longitudinal direction of each opening portion 53A or 53B of the outlet port, and is sent out.

From the above, the air emitted from the plural ventilation portion 71 of the permeable member 70 in each opening portions 53A or 53B of the outlet port is emitted in a substantially equally distributed state from each opening portion 53A or 53B, and is emitted in a state where the wind speed thereof is substantially uniform in the longitudinal direction (B) of the opening shape (elongated oblong shape) of the opening portion 53A or 53B. Additionally, the wind speed of the air that comes out from each opening portion 53A or 53B is brought into a substantially uniform state in the longitudinal direction (B) of the opening shape of each opening portion 53A or 53B as described above, and is brought into a substantially uniform state also in the lateral direction C.

Then, the air sent out from each opening portion 53A or 53B of the outlet port of the blower duct 51E is exclusively blown into the internal space S1 or S2 from the top opening portion 43 of the shielding case 40 of the charging device 4, comes into contact with the grid electrode 42 while passing through each of the two corona discharge wires 41A and 41B in each internal spaces S1 or S2, proceeds so as to escape through the gap between the lower end portion in the lateral portion 40*b* or 40*c* of the shielding case 40 and the grid electrode 42, and finally moves so as to be emitted to the outside of the shielding case 40.

In this case, the air that passes through the internal space S1 or S2 proceeds so as to flow in a substantially uniform state in the longitudinal direction (B) of the internal space, and proceeds so as to flow in a substantially uniform state also in the lateral direction C. Thereby, unnecessary substances, such as a discharge product, paper debris, an additive agent of toner, which are going to adhere to the two discharge wires 41A and 41B and the grid electrode 42, may be kept away without the unevenness, and may be discharged to the outside of the shielding case 40.

Other Exemplary Embodiments

As the flow path 64, the flow paths that have the passage space ST1 and ST2 that are divided into two by the partition wall 55 are illustrated in Exemplary Embodiments 1 to 4. However, a flow path 64 that has three or more passage spaces ST that are divided by plural partition walls 55 may be applied.

Additionally, although the cases where the two flow control members 61 and 62 are provided as the flow control members in the blower duct 51 are shown in Exemplary Embodiments 1 to 4, three or more flow control members may be provided. Additionally, it is preferable to provide all the flow control members which also includes the most downstream flow control member in a part whose cross-sectional shape is changed in the passage space TS of the flow path 54 of the duct 51 or in a part after (immediately after or the like) the air flow direction in the passage space TS is changed.

The case where the most downstream flow control member 62 is configured using the permeable member 70 formed so that the plural ventilation portions (holes) 71 are substantially uniformly dotted throughout each opening portion 53A or 53B of the outlet port is illustrated in Exemplary Embodiment 4. However, in addition to this, the most downstream flow control member may also be configured using the permeable member 70 represented by, for example, porous members (in which the plural ventilation portions 71 are irregular through-gaps), such as a nonwoven fabric applied to filters.

In addition, the blower duct 51 is not limited to the case where the overall shape is illustrated in Exemplary Embodiment 1, and blower ducts having other shapes may be applied. For example, the blower ducts 510 (510A to 510D) illustrated in FIGS. 19A to 19D may also be applied.

Additionally, the charging device 4 to which the blowing device 5 is applied may be a charging device of a type in which the grid electrode 24 is not installed, that is, a so-called corotron type charging device. The charging device 4 may be a charging device using one corona discharge wire 41 or three or more corona discharge wires. Additionally, as the elongated target structure to which the blowing device 5 is applied, a corona discharger that performs neutralization of the photoconductor drum 21 or the like, or a corona discharger that charges or neutralizes members to be charged other than the photoconductor drum may be used. In addition, an elongated structure, in which plural portions against which air are to be blown are present along the longitudinal direction, other than the corona discharger may be used.

Moreover, the configuration of an image forming method or the like is not particularly limited if the image forming apparatus 1 includes an elongated target structure that needs to apply the blowing device 5 to blow air. If necessary, an image forming apparatus that forms an image formed from materials other than developer may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower pipe comprising:

an inlet port that takes in air;

an outlet port that has an elongated opening shape that is parallel to a portion of an elongated target structure in a longitudinal direction and that is arranged so as to face the portion of the elongated target structure in the longitudinal direction against which the air taken in from the inlet port is to be blown and is different from the opening shape of the inlet port;

a flow path that connects the inlet port and the outlet port to cause air to flow therethrough and that are divided by a partition wall, the partition wall being continuously provided from the inlet port to the outlet port and the flow path having a bent portion which bends flow direction substantially at a right angle; and a plurality of flow control members that are respectively provided in different parts in an air flow direction in each of divided passage spaces that are divided by the partition wall and that control the flow of the air, wherein the inlet port and the outlet port are constituted by a plurality of opening portions that are divided by the partition wall, respectively, wherein the plurality of opening portions that constitute the outlet port have elongated opening shapes that are divided by the partition wall in a state where the elongated opening shape of the outlet port is parallel to the longitudinal direction of the target structure, and wherein a flow control member of the plurality of flow control members closest to the inlet port is provided in the vicinity of the bent portion, which makes a portion of each of the flow path narrower than other portion of each of the flow path and makes an elongated gap extending in the longitudinal direction to pass air, wherein a portion of the partition wall between the inlet port and the bent portion is substantially parallel to both an air flow direction at the inlet port and an air flow direction bent by the bent portion.

2. The blower pipe according to claim 1, wherein a flow control member closest to the outlet port among the plurality of flow control members is formed such that each opening portion has a smaller cross-sectional area than the cross-sectional area of each of the passage spaces.

3. The blower pipe according to claim 2, wherein the flow control member closest to the outlet port bends each of the air flow direction.

4. The blower pipe according to claim 1, wherein the target structure is a corona discharger including at least a surrounding member that has an elongated internal space along the longitudinal direction and is formed with a discharging opening portion and an air introduction opening portion, and a plurality of discharge wires that are stretched in parallel along the longitudinal direction within the internal space of the surrounding member.

5. The blower pipe according to claim 4, wherein the opening portion of the outlet port of each of the passage spaces is formed so that a direction in which air is emitted is a direction in which the discharge wires of the corona discharger are not present on an extension line of a centerline of the direction which air is emitted.

6. The blower pipe according to claim 4, wherein the corona discharger includes a boundary plate that is arranged so as to be interposed between the a plurality of discharge wires within the internal space of the surrounding member to divide the internal space, and wherein the opening portion of the outlet port of each of the passage spaces is formed so that a direction in which air is emitted is a direction in which air runs against the boundary plate of the corona discharger while avoiding the plurality of discharge wires.

7. A blowing device comprising:

a blower that sends air; and the blower pipe according to claim 1, wherein the air sent from the blower is taken in from each of the opening portions of the inlet port of the blower pipe.

8. The blowing device according to claim 7, wherein the target structure is a corona discharger including at least a surrounding member that has an elongated internal space along the longitudinal direction and is formed with a discharging opening portion and an air introduction opening portion, and a plurality of discharge wires that are stretched in parallel along the longitudinal direction within the internal space of the surrounding member.

9. An image forming apparatus comprising:

an elongated target structure against which air is to be blown; and a blowing device that blows air toward a portion of the target structure in the longitudinal direction, wherein the blowing device is the blowing device according to claim 7.

10. The image forming apparatus according to claim 9, wherein the target structure is a corona discharger including at least a surrounding member that has an elongated internal space along the longitudinal direction and is formed with a discharging opening portion and an air introduction opening portion, and a plurality of discharge wires that are stretched in parallel along the longitudinal direction within the internal space of the surrounding member.

11. The blower pipe according to claim 1, wherein the flow path has a second bent portion which bends flow direction and is provided on downstream of the bent portion, and wherein the partition wall bends according to the second bent portion.

12. A blower pipe comprising:

an inlet port that takes in air;

an outlet port that has an elongated opening shape that is parallel to a portion of an elongated target structure in a longitudinal direction and that is arranged so as to face the portion of the elongated target structure in the longitudinal direction against which the air taken in from the inlet port is to be blown and is different from the opening shape of the inlet port;

a flow path that connects the inlet port and the outlet port to cause air to flow therethrough and that are divided by a partition wall, the partition wall being continuously provided from the inlet port to the outlet port and the flow path having a bent portion which bends flow direction substantially at a right angle;

a plurality of flow control members that are respectively provided in different parts in an air flow direction in each of divided passage spaces that are divided by the partition wall and that control the flow of the air; and a permeable member having a plurality of ventilation portions and provided in the opening portion of the outlet port, wherein the inlet port and the outlet port are constituted by a plurality of opening portions that are divided by the partition wall, respectively, and wherein the plurality of opening portions that constitute the outlet port have elongated opening shapes that are divided by the partition wall in a state where the elongated opening shape of the outlet port is parallel to the longitudinal direction of the target structure, wherein a flow control member of the plurality of flow control members closest to the inlet port is provided in the vicinity of the bent portion, which makes a portion of each of the flow path narrower than other portion of each of the flow path and makes an elongated gap extending in the longitudinal direction to pass air, and wherein the opening portion is closed by the permeable member.

* * * * *